US011596282B2

(12) United States Patent
Moeller et al.

(10) Patent No.: US 11,596,282 B2
(45) Date of Patent: Mar. 7, 2023

(54) VACUUM CLEANER

(71) Applicant: MILWAUKEE ELECTRIC TOOL CORPORATION, Brookfield, WI (US)

(72) Inventors: Scott T. Moeller, Richfield, WI (US); Michael A. Verhagen, Milwaukee, WI (US); Kyle Reeder, Waukesha, WI (US); John S. Scott, Brookfield, WI (US); Nicole Pierski, Shorewood, WI (US); Justin D. Dorman, Wauwatosa, WI (US); Bennett W. Westling, Milwaukee, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 409 days.

(21) Appl. No.: 16/445,503

(22) Filed: Jun. 19, 2019

(65) Prior Publication Data

US 2019/0380548 A1 Dec. 19, 2019

Related U.S. Application Data

(60) Provisional application No. 62/764,878, filed on Aug. 16, 2018, provisional application No. 62/687,090, filed on Jun. 19, 2018.

(51) Int. Cl.

*A47L 5/22* (2006.01)
*A47L 5/36* (2006.01)

(Continued)

(52) U.S. Cl.

CPC ..... *A47L 5/225* (2013.01); *A47L 5/36* (2013.01); *A47L 7/0095* (2013.01); *A47L 9/009* (2013.01);

(Continued)

(58) Field of Classification Search

CPC ..... A47L 5/225; A47L 5/36; A47L 7/0095; A47L 9/009; A47L 9/322; A47L 9/2884;

(Continued)

(56) References Cited

U.S. PATENT DOCUMENTS 4,934,017 A * 6/1990 Kent ..... A47L 9/165 15/329
6,122,796 A * 9/2000 Downham ..... A47L 5/362 15/328

(Continued)

FOREIGN PATENT DOCUMENTS

DE 102015005865 A1 * 11/2016 ..... A47L 7/0004
EP 1815777 A1 * 8/2007 ..... A47L 5/00

(Continued)

OTHER PUBLICATIONS

Machine translation of DE102015005865 (Year: 2021).*

(Continued)

*Primary Examiner* — Orlando E Aviles
*Assistant Examiner* — Sarah Akyaa Fordjour
(74) *Attorney, Agent, or Firm* — Michael Best & Friedrich LLP

(57) ABSTRACT

A portable vacuum cleaner comprises a housing including a storage space and a lid coupled to the housing. The lid is moveable between an open position, in which access to the storage space is provided, and a closed position, in which access to the storage space is blocked. The vacuum cleaner further comprises a handle coupled to the housing, a suction source supported in the housing, a debris collection chamber in fluid communication with the suction source, and a first battery receptacle on the housing. The first battery receptacle is configured to selectively receive a first battery pack that is configured to provide power to the suction source. The vacuum cleaner further comprises a hose port on the housing and in fluid communication with the suction source.

9 Claims, 23 Drawing Sheets

(51) Int. Cl.
*A47L 9/00* (2006.01)
*A47L 9/32* (2006.01)
*A47L 9/28* (2006.01)
*A47L 7/00* (2006.01)

(52) U.S. Cl.
CPC ..... *A47L 9/0036* (2013.01); *A47L 9/2884* (2013.01); *A47L 9/322* (2013.01)

(58) Field of Classification Search
CPC ..... A47L 9/0036; A47L 9/1409; A47L 9/122; A47L 9/248; A47L 9/2857; A47L 5/365; A47L 9/0009; A47L 7/0004
USPC ..... 15/328, 353
See application file for complete search history.

(56) References Cited

U.S. PATENT DOCUMENTS 8,015,657 B2 9/2011 Beers et al.
8,973,196 B2 * 3/2015 Tomasiak ..... A47L 7/0038 15/3
2008/0040883 A1 * 2/2008 Beskow ..... A47L 9/165 15/329
2010/0199453 A1 8/2010 Brotto et al.
2011/0239398 A1 10/2011 Furusawa et al.
2014/0373306 A1 12/2014 Tomasiak
2015/0093973 A1 4/2015 Sergyeynko et al.
2015/0223652 A1 8/2015 Koura et al.
2016/0100724 A1 4/2016 Valentini
2018/0132682 A1 5/2018 Bearup et al.

FOREIGN PATENT DOCUMENTS

EP 3272261 A2 1/2018
KR 100762328 B1 * 10/2007

OTHER PUBLICATIONS

Machine translation of KR100762328B1 (Year: 2022).*
Machine translation of EP-1815777-A1 (Year: 2022).*
Translation of EP-1815777-A1 (Year: 2022).*
Translation of DE-102015005865-A1 (Year: 2022).*

* cited by examiner

VACUUM CLEANER

CROSS-REFERENCE TO RELATED APPLICATIONS

This application claims priority to U.S. Provisional Patent Application No. 62/687,090 filed on Jun. 19, 2018, and Provisional Patent Application No. 62/764,878 filed on Aug. 16, 2018, and the entire contents of both Provisional Applications are incorporated herein by reference.

FIELD OF THE INVENTION

The present invention relates to vacuum cleaners, and more particularly to portable vacuum-out arrangements.

BACKGROUND OF THE INVENTION

On job sites, operators use vacuum cleaners to clean up dust and debris. Operators also use AC power sources to power cutting, sawing, and drilling tools.

SUMMARY OF THE INVENTION

The present invention provides, in one aspect, a portable vacuum cleaner comprising a housing including a storage space and a lid coupled to the housing. The lid is moveable between an open position, in which access to the storage space is provided, and a closed position, in which access to the storage space is blocked. The vacuum cleaner further comprises a handle coupled to the housing, a suction source supported in the housing, a debris collection chamber in fluid communication with the suction source, and a first battery receptacle on the housing. The first battery receptacle is configured to selectively receive a first battery pack that is configured to provide power to the suction source. The vacuum cleaner further comprises a hose port on the housing and in fluid communication with the suction source.

The present invention provides, in another aspect, a portable vacuum cleaner assembly comprising a first portable vacuum and a second portable vacuum cleaner. Each of the first and second portable vacuum cleaners include a housing including a storage space and a lid coupled to the housing. The lid is moveable between an open position, in which access to the storage space is provided, and a closed position, in which access to the storage space is blocked. Each of the first and second portable vacuum cleaners also include a handle coupled to the housing, a suction source supported in the housing, a debris collection chamber in fluid communication with the suction source, and a battery receptacle on the housing. The battery receptacle is configured to selectively receive a battery pack that is configured to power to the suction source. Each of the first and second portable vacuum cleaners also include a hose port on the housing and in fluid communication with the suction source. The housing of the first portable vacuum has a first size and the housing of the second portable vacuum has a second size that is greater than the first size. The first portable vacuum is configured to be stacked upon the second portable vacuum.

The present invention provides, in yet another aspect, a vacuum cleaner comprising a first portion including a nozzle defining a first axis and a debris collection chamber defining a second axis. The vacuum cleaner further comprises a second portion including a handle, a motor defining a third axis, a fan driven by the motor, a filter defining a fourth axis, and a battery for providing power to the motor. The first portion is removably coupled to the second portion, and the first, second, third and fourth axes are coaxial when the first portion is coupled to the second portion.

The present invention provides, in yet another aspect, a vacuum cleaner comprising a nozzle, a debris collection chamber, a handle, a motor defining a motor axis, a fan driven by the motor, a filter, and a battery pack for providing power to the motor. The motor is arranged in between the handle and the battery pack along a first axis that is perpendicular to the motor axis.

The present invention provides, in yet another aspect, a vacuum cleaner assembly comprising a first vacuum cleaner including a housing having a plurality of wheels, a debris collection chamber, a suction source arranged in the housing, and a power cord configured to be coupled to an AC power source such that when the power cord is coupled to the AC power source, the power cord can transmit power to the suction source. The first vacuum cleaner further includes a lid removably coupled to the housing. The lid includes a handle and a hose port that is fluidly coupled to the suction source when the lid is coupled to the housing. The vacuum cleaner assembly further comprises a second vacuum cleaner including a battery. The second vacuum cleaner is configured to be docked on the first vacuum cleaner. When the second vacuum cleaner is docked on the first vacuum cleaner and the power cord is coupled to the AC power source, the power cord can transmit power to the battery.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1B:
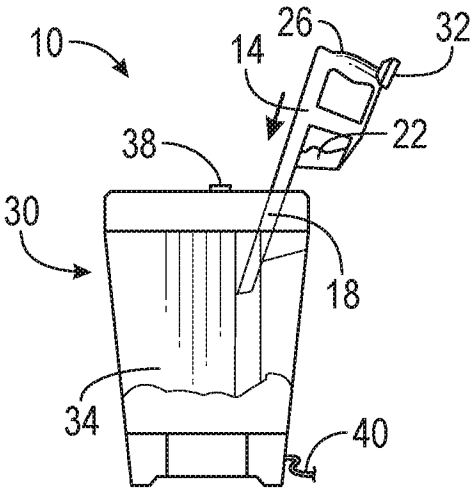
FIG. 1B is a cross-sectional view of the stick station of FIG. 1A, with the vacuum cleaner of FIG. 1A being inserted therein.
Figure 1D:
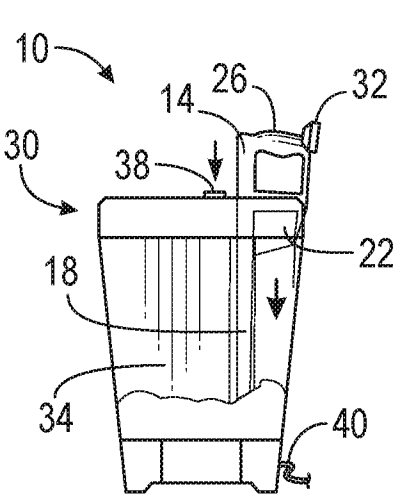
FIG. 1D is a cross-sectional view of the stick station of FIG. 1A, with the vacuum cleaner of FIG. 1A emptying debris therein.
Figure 1C:
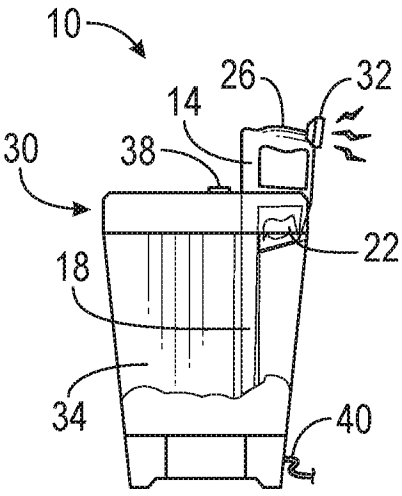
FIG. 1C is a cross-sectional view of the stick station of FIG. 1A, with the vacuum cleaner of FIG. 1A docked therein.
Figure 1A:
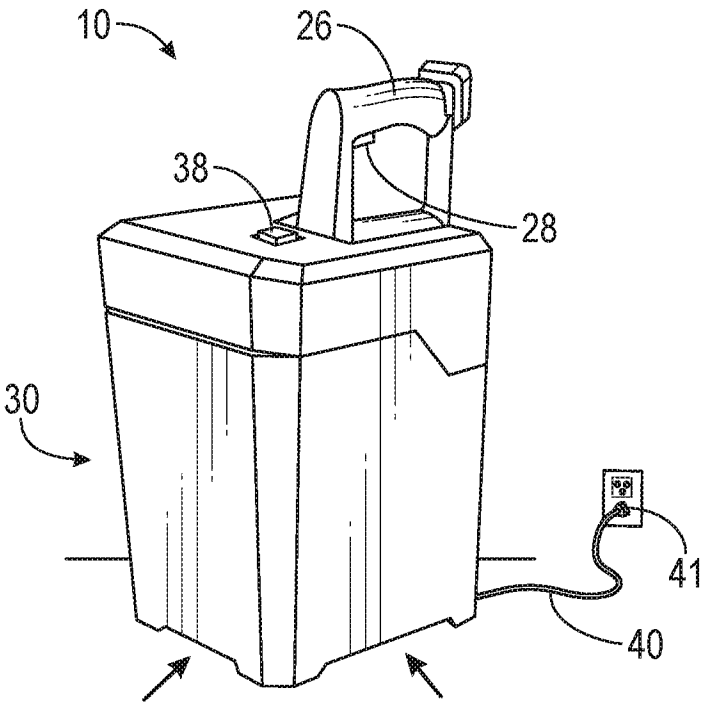
FIG. 1A is a perspective view of a stick station with a vacuum cleaner docked therein.

As shown in FIGS. 1A-1D, a vacuum cleaner 10 includes a body 14, a suction nozzle 18, a debris collection chamber 22, a handle 26, and a trigger 28 for actuating a suction motor (not shown) that is powered by a power source such as a battery or battery pack 32. The vacuum cleaner 10 is insertable into a station 30 having a dust bin 34. When the vacuum cleaner 10 is inserted into the station 30, the battery or battery pack 32 can be recharged via the station 30 (FIG. 1C). Also, while the vacuum cleaner 10 is inserted in the station 30, a button 38 on the station 30 is depressible to cause the contents of the debris collection chamber 22 of the vacuum cleaner 10 to empty into the dust bin 34 of the station 30 (FIG. 1D). The station 30 includes a power cord 40 for plugging into an AC electrical outlet 41.

Figure 15:
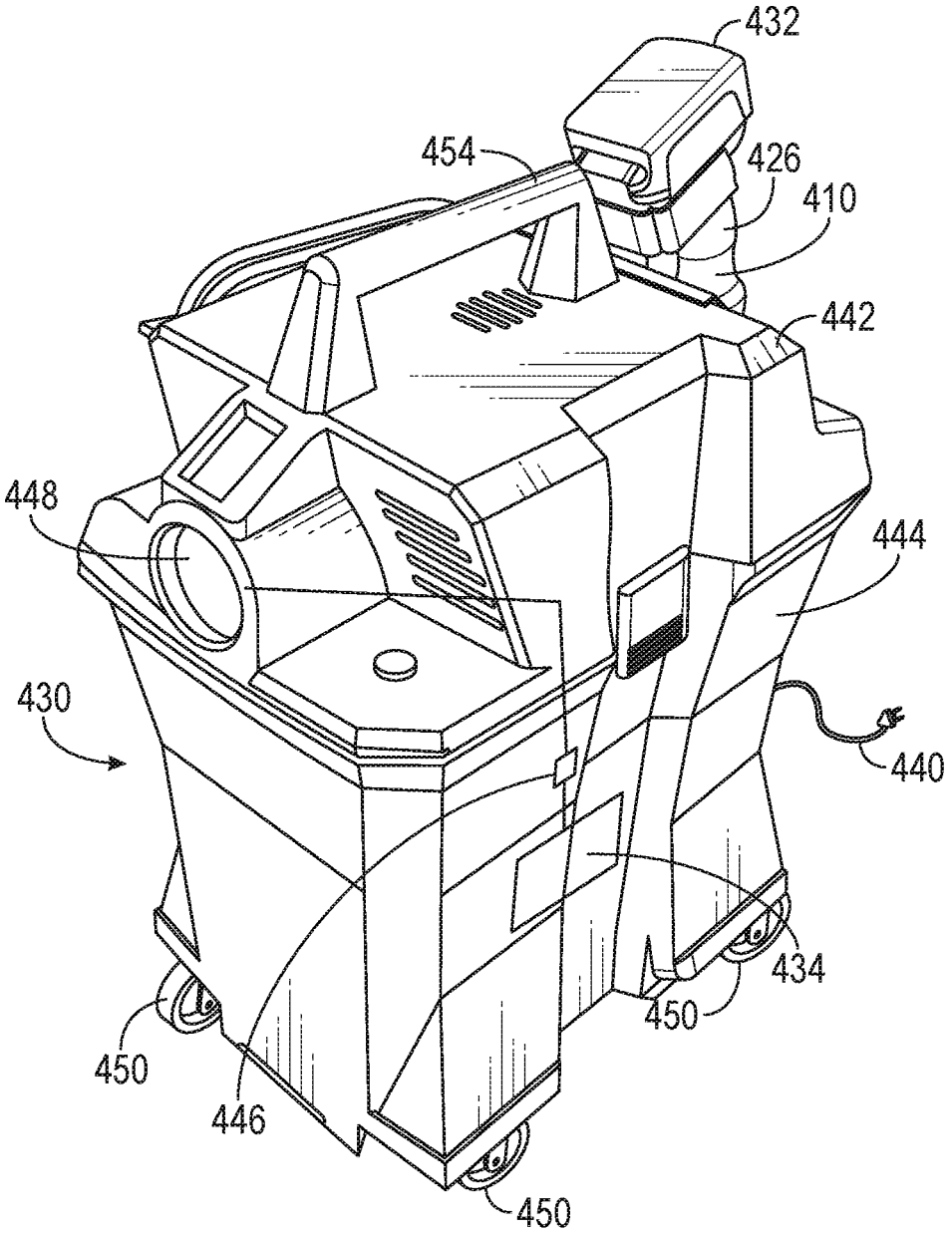
FIG. 15 is a perspective view of a vacuum cleaner according to another embodiment of the invention, with a hand held vacuum cleaner docked therein.
Figure 16:
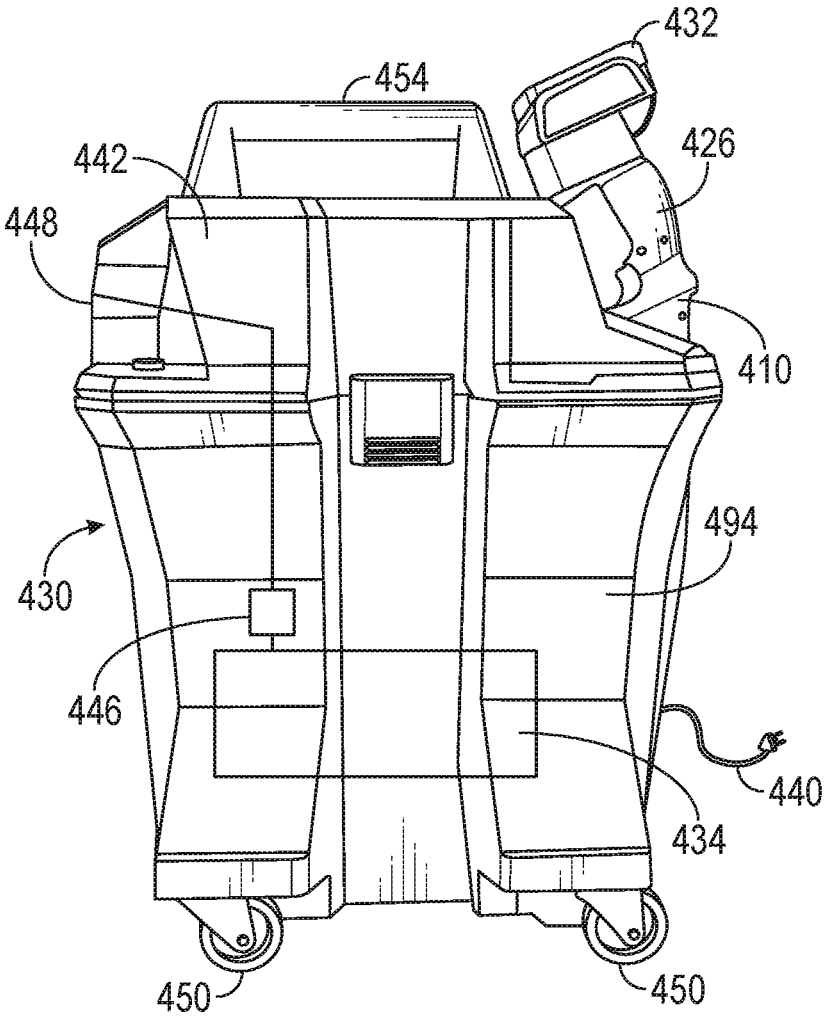
FIG. 16 is a plan view of the vacuum cleaner of the vacuum cleaner of FIG. 15, with the hand held vacuum cleaner docked therein.
Figure 17:
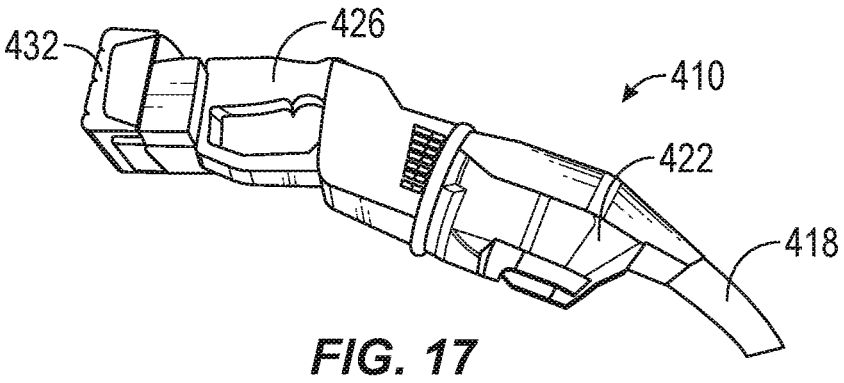
FIG. 17 is a perspective view of the hand held vacuum cleaner of FIG. 15.

FIG. 17 illustrates a vacuum cleaner 410 that is substantially similar to the vacuum cleaner 10 FIGS. 1A-1D, with like parts having the same annotation plus "400". Similarly, FIGS. 15 and 16 illustrate a vacuum cleaner 430 that is substantially identical to the station 30 of FIG. 1A-1D, with like parts having the same annotation plus "400". However, unlike station 30, vacuum cleaner 430 is a vacuum cleaner. Like the embodiment shown in FIGS. 1A-1D, the vacuum cleaner 410 is insertable into the vacuum cleaner 430 having a dust bin 434. When the vacuum cleaner 410 is inserted into the vacuum cleaner 430, the battery or battery pack 432 can be recharged via the vacuum cleaner 430 (FIGS. 15 and 16), via the power cord 440. Also, while the vacuum cleaner 410 is inserted in the vacuum cleaner 430, a button 438 on the vacuum cleaner 430 is depressible to cause the contents of the debris collection chamber 422 of the vacuum cleaner 410 to empty into the dust bin 434 of the vacuum cleaner 430.

In addition, the vacuum cleaner 430 has several additional features and differences, in comparison with the station 30, that are explained below. The vacuum cleaner includes a lid 442 that is separable from a body 444, to allow access to the dust bin 434 in the body 444. The vacuum cleaner 430 includes a plurality of latches 445 to secure the lid 442 to the body 444. The vacuum cleaner 410 mounts the vacuum cleaner 430 through the lid 442. The vacuum cleaner 430 also includes a suction source 446, such as a motor-driven fan, that receives power via the power cord 440. The suction source 446 is fluidly connected to a hose port 448 and the dust bin 434, such that a hose can be coupled to the hose port 448, and the suction source 446 can be run to suction material through the hose port 446 and into the dust bin 434. Thus, unlike the station 30, the vacuum cleaner 430 can be operated as an independent canister vacuum cleaner. Further, the body 444 includes a plurality of wheels 450, such as castor wheels, and the lid includes a handle 454, making it easier for an operator to wheel the vacuum cleaner 430 between different spots at a job site to suction debris. However, when the smaller, cordless, battery-powered vacuum cleaner 410 is needed to reach a tight corner or spot that is inaccessible to vacuum cleaner 430, the operator may decouple vacuum cleaner 410 from the vacuum cleaner 430.

Figure 2A:
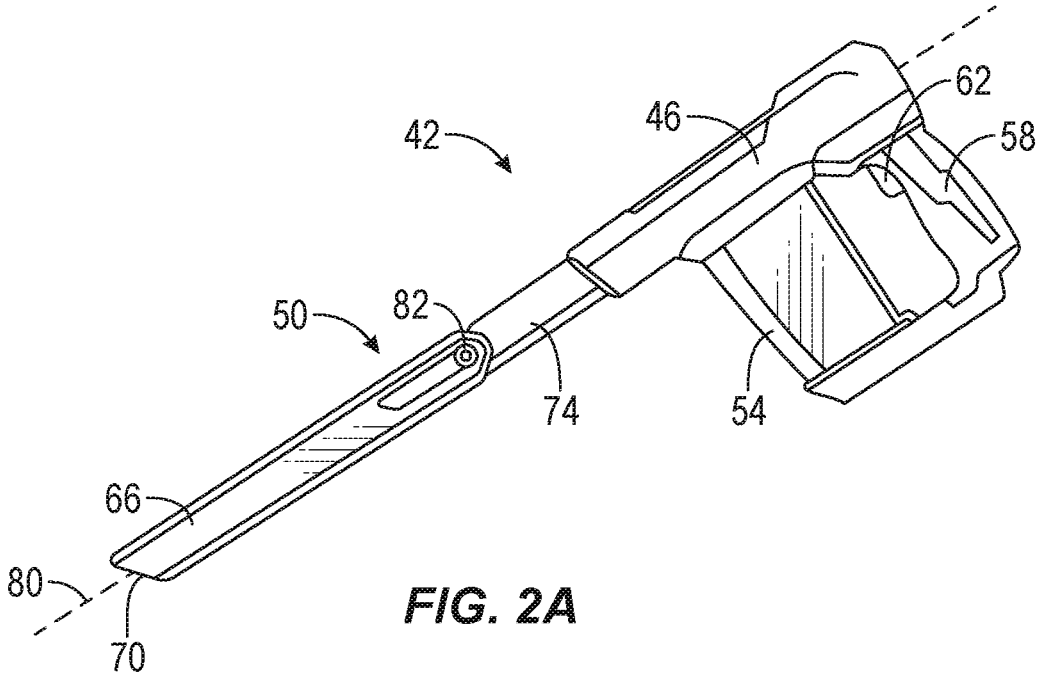
FIG. 2A is a plan view of a vacuum cleaner according to another embodiment of the invention, with a nose in a first position.
Figure 2B:
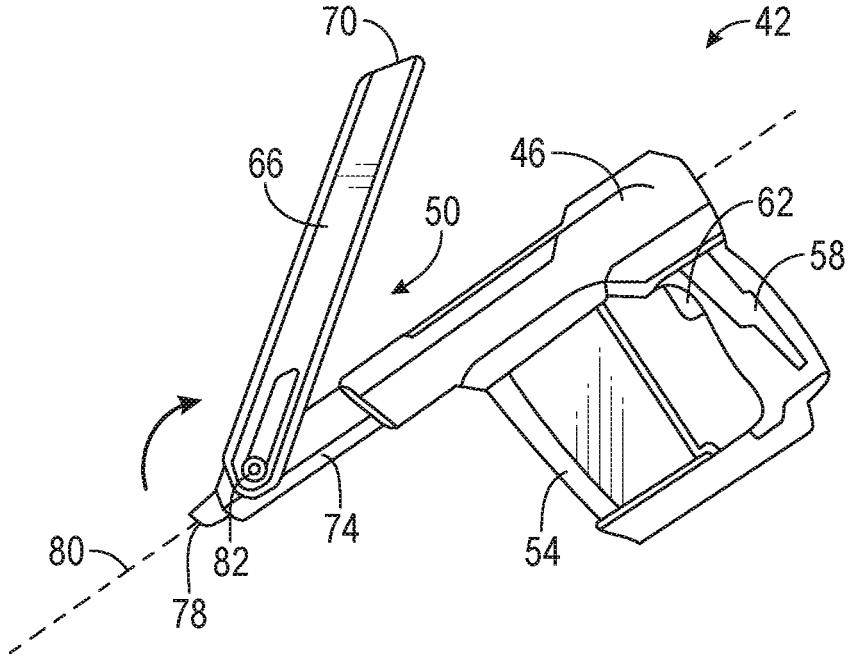
FIG. 2B is a plan view of the vacuum cleaner of FIG. 2A, with the nose in a second position.

As shown in FIGS. 2A and 2B, a vacuum cleaner 42 includes a body 46, a suction nozzle 50, a debris collection chamber 54, a handle 58, and a trigger 62 for actuating a suction motor (not shown) that is powered by a power source such as a battery or battery pack (not shown). The suction nozzle 50 includes a nose 66 with a first suction opening 70 and an extension 74 from body 46 that has a second suction opening 78. When the nose 66 is in a first position (FIG. 2A), the nose 66 extends along an axis 80 that is defined by the extension 74, and the second suction opening 78 is covered by the nose 66. Thus, when operated in the first position, dirty air passes into the first suction opening 70, through the nose 66, through the extension 74, and into the debris collection chamber 54. When the nose is pivoted about a pivot joint 82 from the first position to a second position in which the nose 66 does not lie along the axis 80 defined by the extension 74 (FIG. 2B), operation of the vacuum cleaner 10 causes dirty air to enter directly through the second suction opening 78, rather than passing through first suction opening 70 and nose 66.

Figure 3:
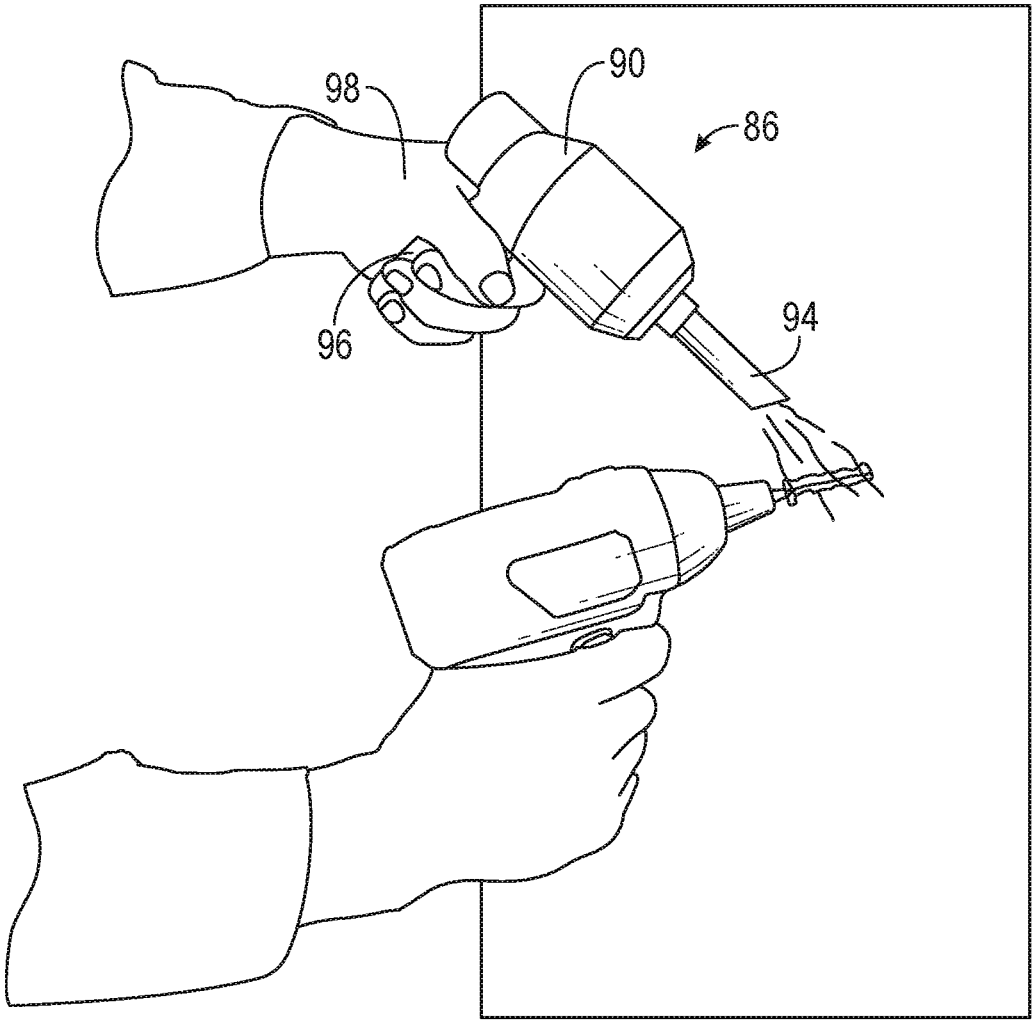
FIG. 3 is a perspective view of a vacuum cleaner according to another embodiment of the invention.

As shown in FIG. 3, a vacuum cleaner 86 includes a body 90, a suction nozzle 94, a debris collection chamber (not shown), a handle 96, and a trigger (not shown) for actuating a suction motor (not shown) that is powered by a power source such as a battery or battery pack (not shown). The handle is graspable with one hand 98 of an operator and the nozzle 94 is adept at cleaning small messes.

Figure 4B:
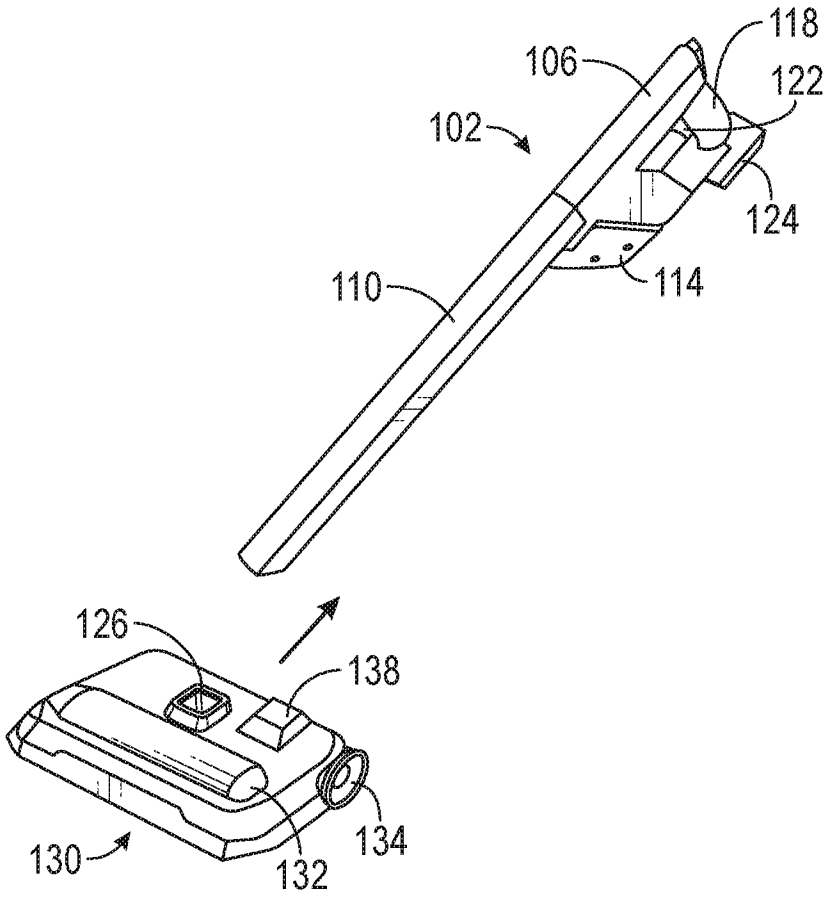
FIG. 4B is a perspective view of the vacuum cleaner of 4A removed from the power base.
Figure 4A:
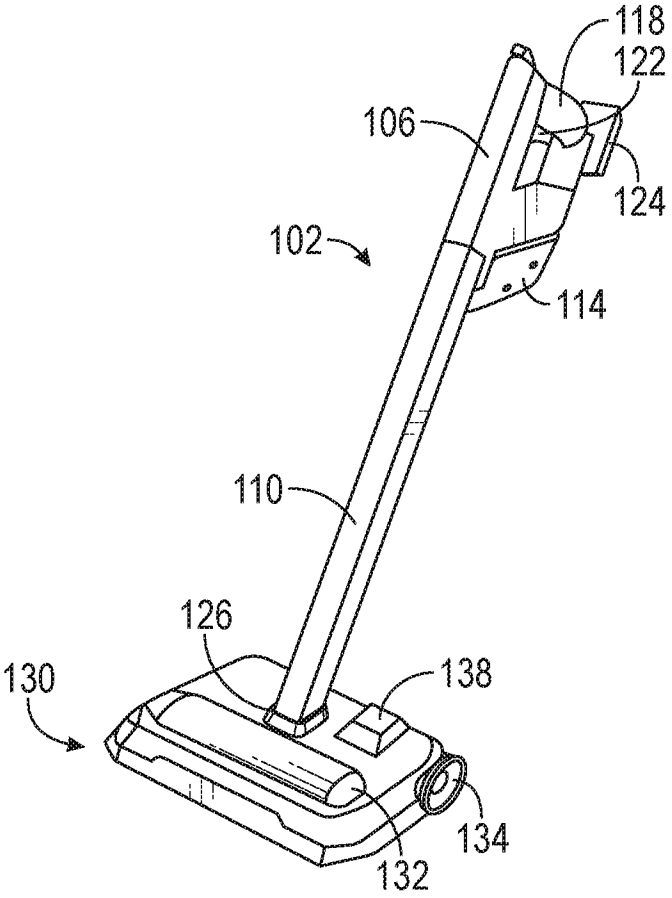
FIG. 4A is a perspective view of a vacuum cleaner according to another embodiment of the invention, coupled to a power base.
Figure 5A:
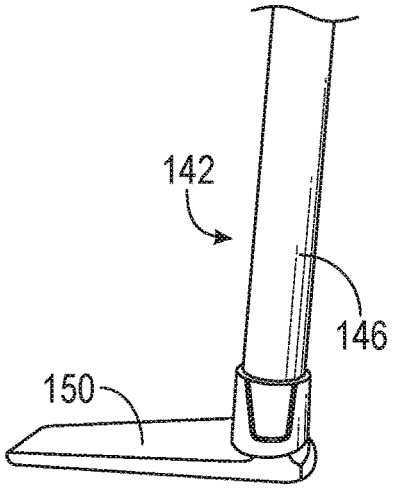
FIG. 5A is perspective view of a vacuum cleaner according to another embodiment of the invention.
Figure 5B:
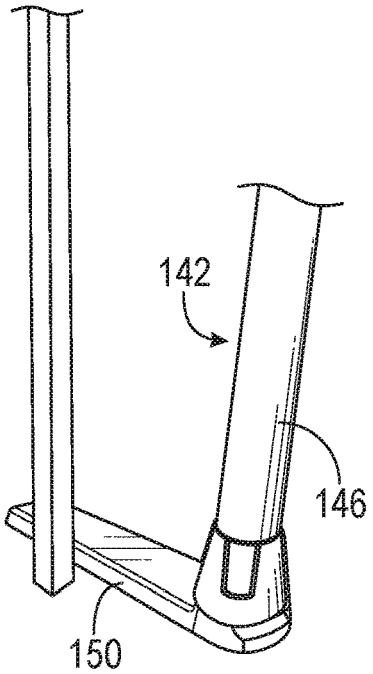
FIG. 5B is a perspective view of the vacuum cleaner of FIG. 5A.
Figure 5C:
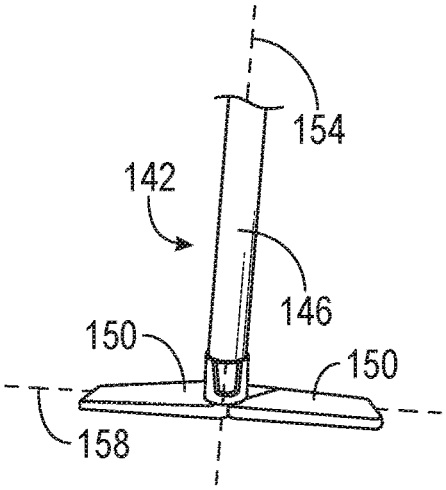
FIG. 5C is a perspective view of a vacuum cleaner according to another embodiment of the invention.
Figure 5D:
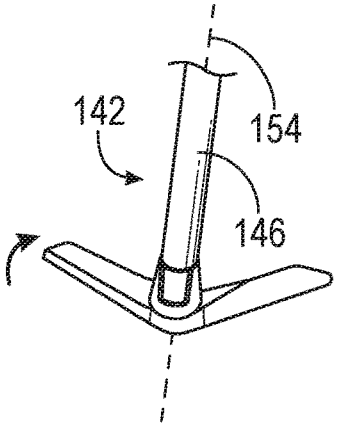
FIG. 5D is perspective view of the vacuum cleaner of FIG. 5C.
Figure 5E:
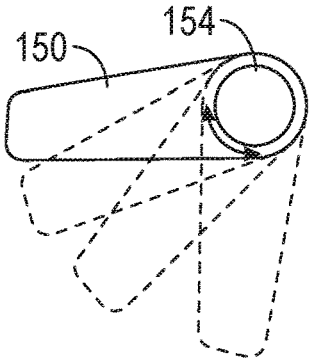
FIG. 5E is a cross-sectional view of the vacuum cleaner of FIG. 5A showing different positions of a wing of the vacuum cleaner.

As shown in FIGS. 4A and 4B, a vacuum cleaner 102 includes a body 106, a suction nozzle 110, a debris collection chamber 114, a handle 118, and a trigger 122 for actuating a suction motor (not shown) that is powered by a power source such as a battery or battery pack 124. The vacuum cleaner 102 is insertable into a receptacle 126 of a powered base 130 for floor operations. The powered base 130 includes a brushroll indicated at 132, wheels 134, and a release actuator 138. In operation, as shown in FIG. 4A, the suction nozzle 110 is inserted into the receptacle 126 and the trigger 122 is depressed to operate the vacuum cleaner 102 and the powered base 130. Specifically, air and debris is suctioned from under powered base 130 and into the suction nozzle 110 before entering the debris collection chamber 114. In some embodiments, the power source of vacuum cleaner 102 may power the brushroll 132 of the powered base 130. In other embodiments, powered base 130 is powered separately. When finished with floor operations, the operator hits release actuator 138 to release the suction nozzle 110 from the receptacle 126, thus allowing the vacuum cleaner 102 to be used without powered base 130, as shown in FIG. 4B.

As shown in FIG. 5, a suction nozzle 142 for a vacuum cleaner includes a wand portion 146 and one (FIGS. 5A and 5B) or more (FIGS. 5C and 5D) wings 150 which glide along a surface during cleaning. The one or more wings 150 communicate suctioned air to wand portion 146 and can pivot about an axis 154 defined by the wand portion 146, thus allowing wings to pivot about axis 154 when striking obstacles during cleaning. In the embodiment shown in FIGS. 5C and 5D, the wings 150 are biased towards a neutral position in which they are arranged along the same axis 158.

Figure 6C:
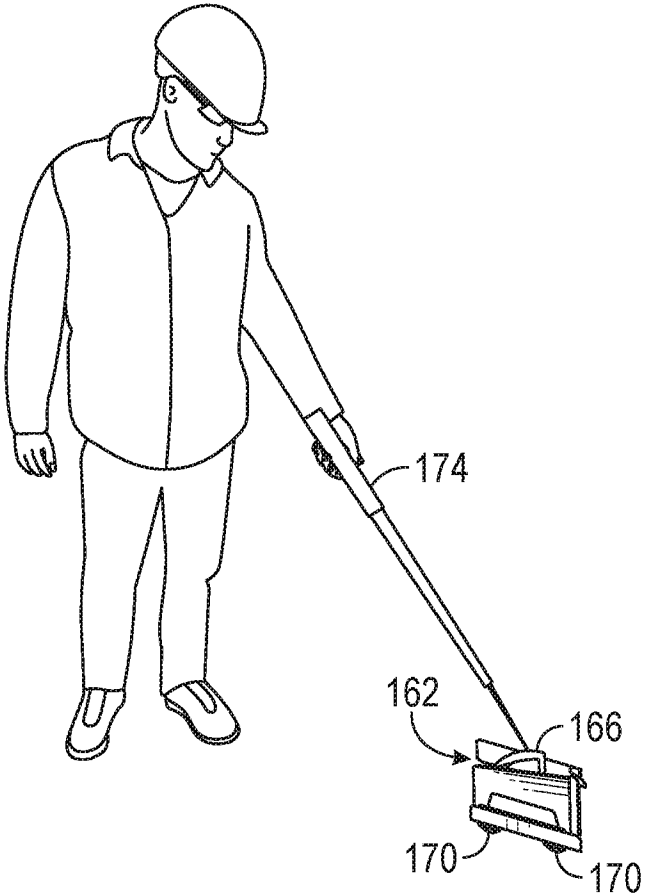
FIG. 6C is a perspective view of the vacuum cleaner of FIG. 6A.
Figure 6A:
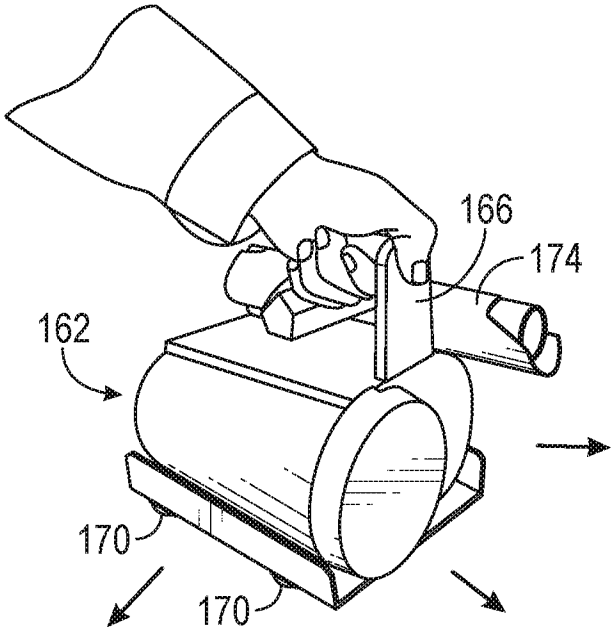
FIG. 6A is a perspective view of a vacuum cleaner according to another embodiment of the invention.
Figure 6B:
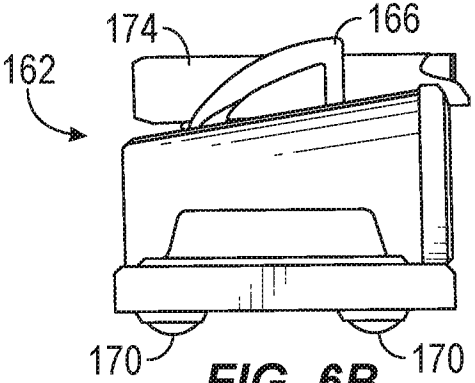
FIG. 6B is a plan view of the vacuum cleaner of FIG. 6A.

As shown in FIGS. 6A-6C, a vacuum cleaner 162 includes a body handle 166, omnidirectional castors 170, and a telescoping handle 174 allowing an operator to push the vacuum cleaner 162 around a floor.

Figure 7:
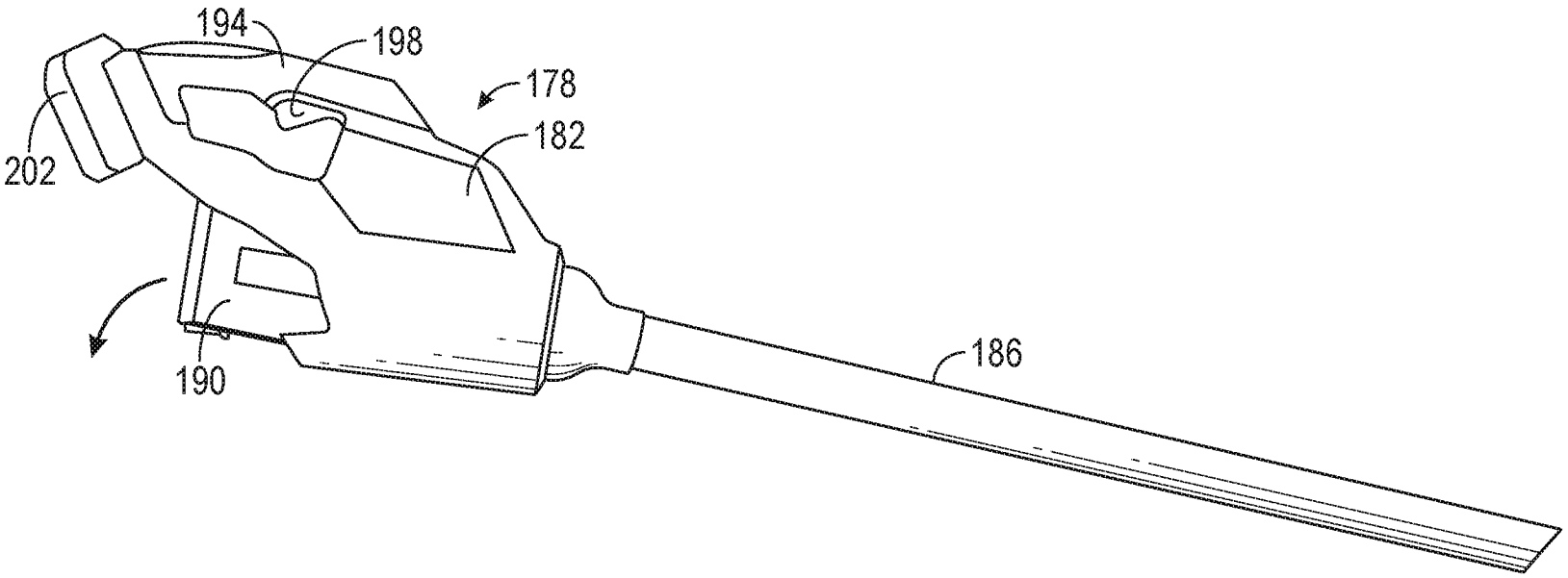
FIG. 7 is a plan view of a vacuum cleaner according to another embodiment of the invention.

As shown in FIG. 7, a vacuum cleaner 178 includes a body 182, a suction nozzle 186, a debris collection chamber 190, a handle 194, and a trigger 198 for actuating a suction motor (not shown) that is powered by a power source such as a battery or battery pack 202. The debris collection chamber 190 is removable from the body 182 of the vacuum cleaner 178.

Figure 8A:
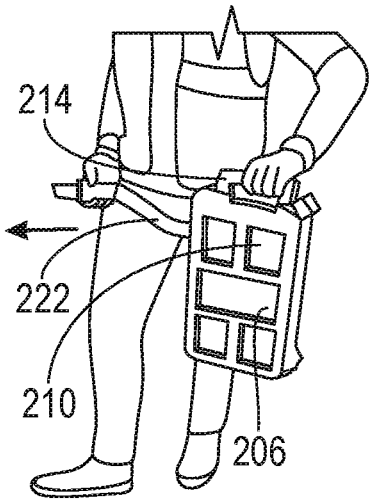
FIG. 8A is a perspective view of a vacuum cleaner according to another embodiment of the invention.
Figure 8B:
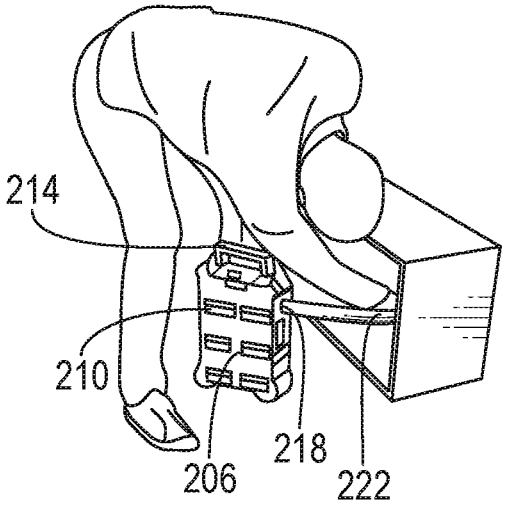
FIG. 8B is a perspective view of the vacuum cleaner of FIG. 8A.
Figure 8C:
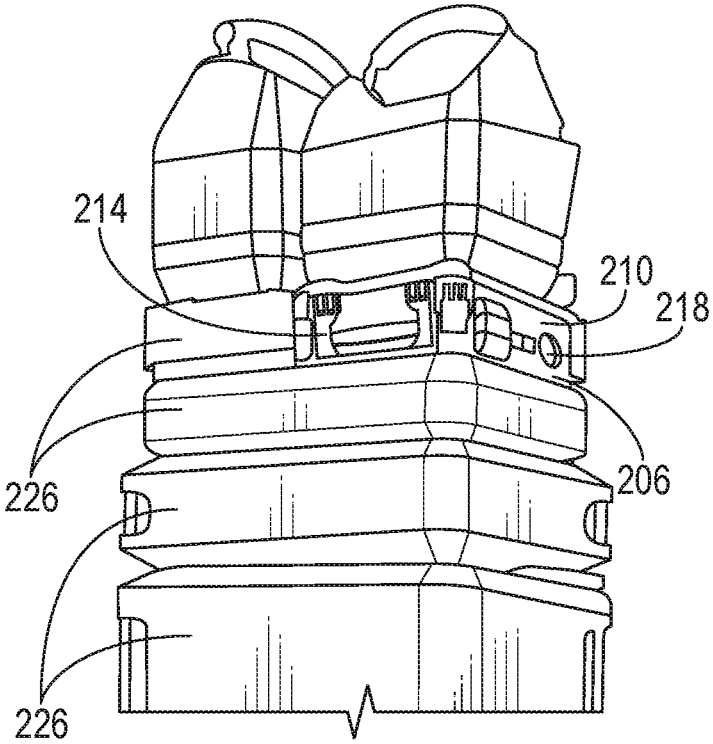
FIG. 8C is a perspective view of the vacuum cleaner of FIG. 8A being stacked among a plurality of tool boxes.

As shown in FIGS. 8A-8C, a vacuum cleaner 206 has a body 210 with a shape of a tool box, a handle 214 and a port 218 for attaching a hose 222 for a suction operation. Thus, the vacuum cleaner 206 is stackable among a plurality of other tool boxes 226.

Figure 18:
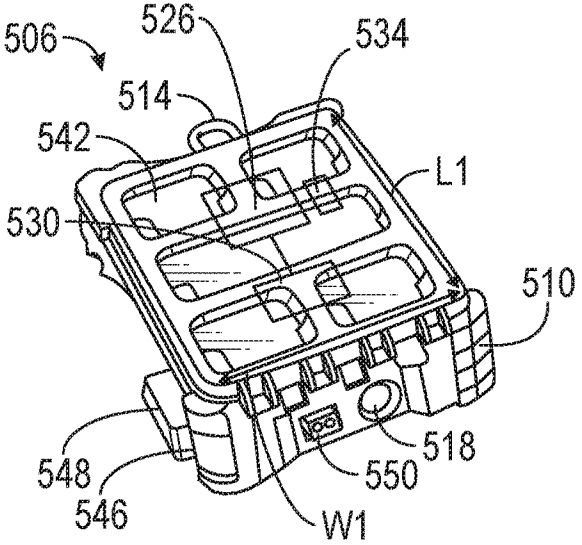
FIG. 18 is a perspective view of a vacuum cleaner according to another embodiment of the invention.
Figure 22:
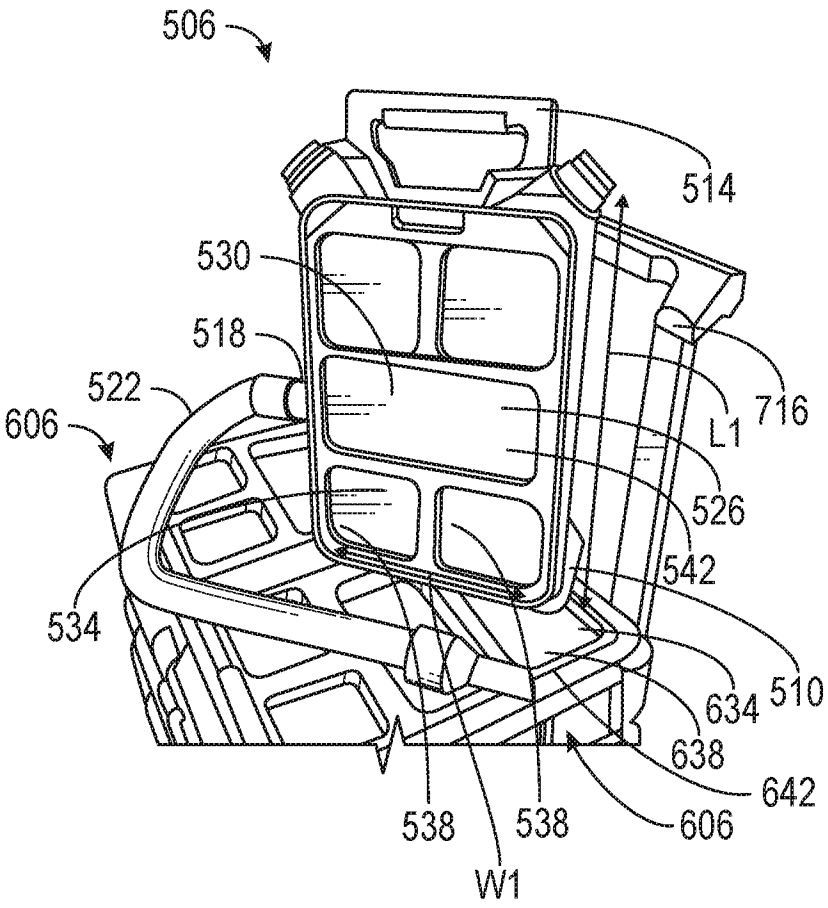
FIG. 22 is a perspective view of the vacuum cleaner of FIG. 18.

FIGS. 18 and 22 illustrates a vacuum cleaner 506 having a housing 510 with a shape of a flat tool box, a handle 514 and a hose port 518 for attaching a hose 522 for a suction operation. As shown in FIGS. 18 and 22, the housing 510 has a length L1 and a width W1. The hose port 518 can be arranged along different sides of the vacuum cleaner 506, as shown by comparison between FIGS. 18 and 22. The vacuum cleaner 506 includes a suction source 526, such as a motor-driven fan, that is in fluid communication with the hose port 518 and a debris collection chamber 530 in the housing 510. The housing 510 also includes a storage space 534 including a plurality of compartments 538 to store, for example, different tools and worksite accessories.

A lid 542 is coupled to the housing 510 and is moveable between an open position, in which access to the storage space 534 is provided, and a closed position, in which access to the storage space 534 is blocked. In the embodiment shown in FIG. 22, the lid 542 is transparent, such that an operator can identify what tools and accessories are stored in the different compartments 538 of the storage space 534. In some embodiments, the lid 542 can be moved to the open position to provide access to the debris collection chamber 530 and in some embodiments, the lid 542 can be moved to the open position to provide access to the suction source 526. The vacuum cleaner 506 also includes a battery receptacle 546 for receipt of a battery pack 548 that is configured to power the suction source 526 when received in the battery receptacle 546. In some embodiments, the battery pack 548 is a 12V battery pack. The vacuum cleaner 506 also includes an actuator 550 on the housing 510, such that moving the actuator 550 from an "OFF" position to an "ON" position, while the battery pack 548 is in the battery receptacle 546, turns on the suction source 526 to suction debris through the hose port 518 and into the debris collection chamber 530.

Figure 19:
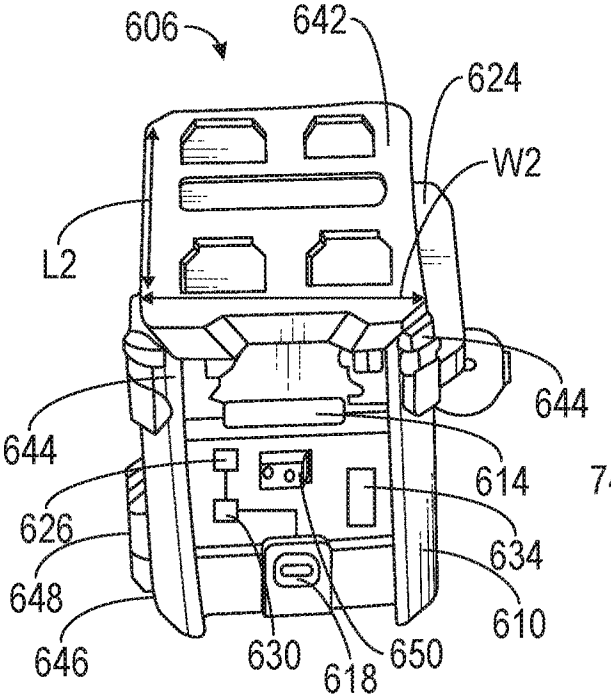
FIG. 19 is a perspective view of a vacuum cleaner according to another embodiment of the invention.
Figure 21:
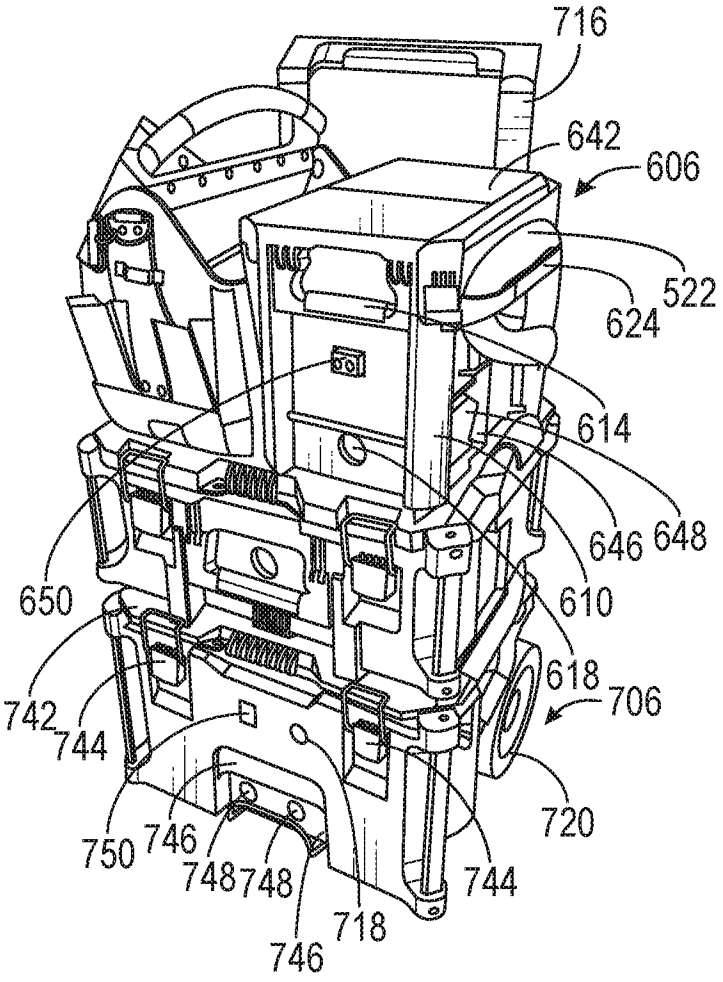
FIG. 21 is a perspective view of the vacuum cleaner of FIG. 19 stacked upon two of the vacuum cleaners of FIG. 20.

FIGS. 19, 21 and 22 illustrate a vacuum cleaner 606 having a housing 610 with a shape of a medium-sized toolbox that is larger than the housing 510 of the vacuum cleaner 506. As shown in FIGS. 18 and 22, the housing 610 has a length L2 and a width W2 that are respectively similar or identical to the length L1 and width W1 of the housing 510 of the vacuum cleaner 506. Thus, since several dimensions are similar or identical, the vacuum cleaner 506 may be stacked on top of the vacuum cleaner 606 in a more convenient and orderly manner. The vacuum cleaner 606 also includes a pair of handles 614 and a hose port 618 for attaching the hose 522 for a suction operation. The vacuum cleaner 606 also includes a bracket 624 on which the hose 522 can be stored, as shown in FIG. 21. The vacuum cleaner 606 includes a suction source 626, such as a motor-driven fan, that is in fluid communication with the hose port 618 and a debris collection chamber 630 in the housing 610.

The housing 610 also includes a storage space 634 including a plurality of compartments 638 to store, for example, different tools and worksite accessories. A lid 642 is coupled to the housing 610 and is moveable between an open position, in which access to the storage space 634 is provided, and a closed position, in which access to the storage space is blocked. A plurality of latches 644 are used to secure the lid 642 in the closed position. In the embodiments shown in FIGS. 21 and 22, the lid 642 is transparent, such that an operator can identify what tools and accessories are stored in the different compartments 638 of the storage space 634. The vacuum cleaner 606 also includes a battery receptacle 646 for receipt of a battery pack 648 that is configured to power the suction source 626 when received in the battery receptacle 646. In some embodiments, the battery pack 648 is an 18V battery pack. The vacuum cleaner 606 also includes an actuator 650 on the housing 610, such that moving the actuator 650 from an "OFF" position to an "ON" position, while the battery pack 648 is in the battery receptacle 646, turns on the suction source 626 to suction debris through the hose port 618 and into the debris collection chamber 630.

Figure 20:
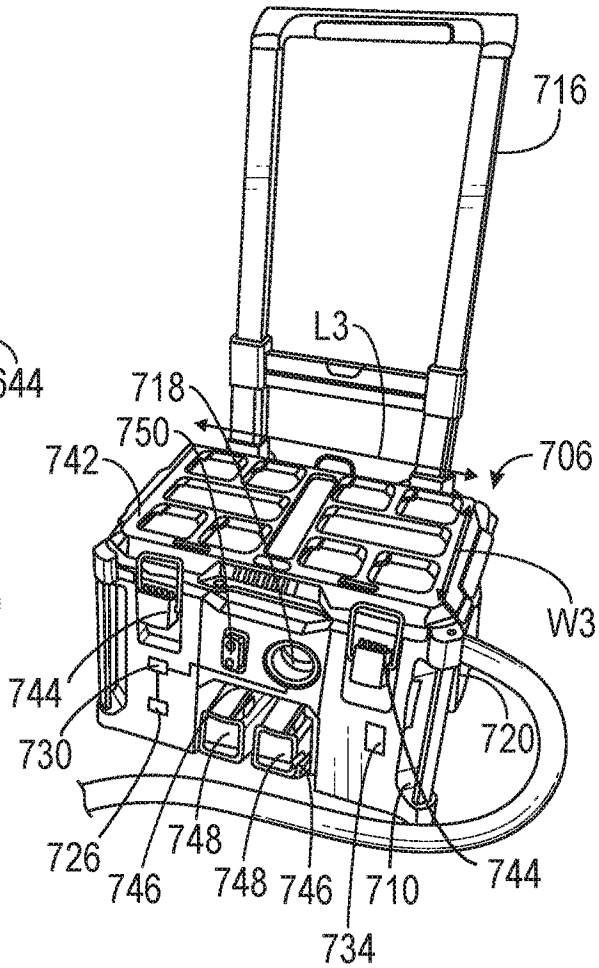
FIG. 20 is a perspective view of a vacuum cleaner according to another embodiment of the invention.

FIGS. 20-22 illustrate a vacuum cleaner 706 having a housing 710 with a shape of a large-sized toolbox that is larger than the housings 510, 610 of the vacuum cleaners 506, 606. As shown in FIG. 20, the housing 710 has a length L3 and a width W3 that are respectively similar or identical to at least one of the lengths L1, L2 and widths W1, W2 of the housings 510, 610 of the vacuum cleaners 506, 606. Thus, since at least one dimension is similar or identical, the vacuum cleaners 506, 606 may be stacked on top of the vacuum cleaner 706 in a more convenient and orderly manner. The vacuum cleaner 706 also includes a pair of side handles 714, a telescoping handle 716, and a hose port 718 for attaching the hose 522 for a suction operation. The vacuum cleaner 706 also includes a pair of wheels 720, such that by grasping the telescoping handle 716, an operator can tilt the vacuum cleaner 706 and roll it along a surface. The vacuum cleaner 706 includes a suction source 726, such as a motor-driven fan, that is in fluid communication with the hose port 718 and a debris collection chamber 730 in the housing 710.

The housing 710 also includes a storage space 734 including a plurality of compartments to store, for example, different tools and worksite accessories. A lid 742 is coupled to the housing 710 and is moveable between an open position, in which access to the storage space 634 is provided, and a closed position, in which access to the storage space is blocked. A plurality of latches 744 are used to secure the lid 742 in the closed position. The vacuum cleaner 606 also includes two battery receptacles 746 that can each receive a battery pack 748 that is configured to power the suction source 726 when received in the battery receptacle 746. In some embodiments, the battery packs 748 are 18V battery packs. The vacuum cleaner 706 also includes an actuator 750 on the housing 710, such that moving the actuator 750 from an "OFF" position to an "ON" position, while the battery packs 748 are in the battery receptacles 746, turns on the suction source 726 to suction debris through the hose port 718 and into the debris collection chamber 730.

Figure 9C:
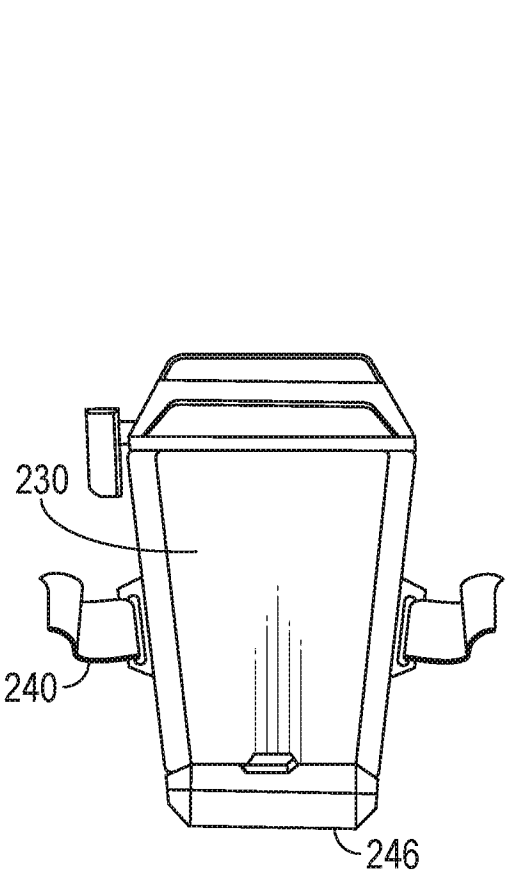
FIG. 9C is a plan view of the vacuum cleaner of FIG. 9A coupled to the holster.
Figure 9B:
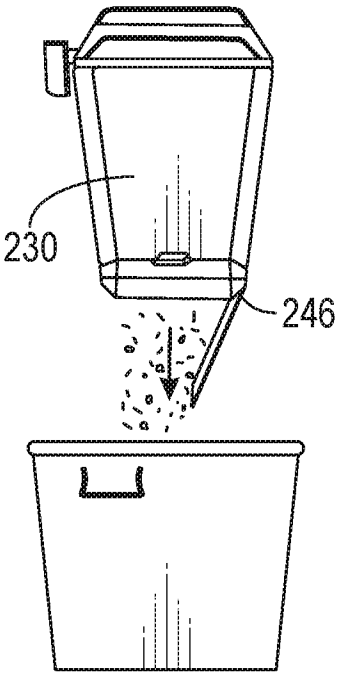
FIG. 9B is a plan view of the vacuum cleaner of FIG. 9A opening a door to empty debris.
Figure 9A:
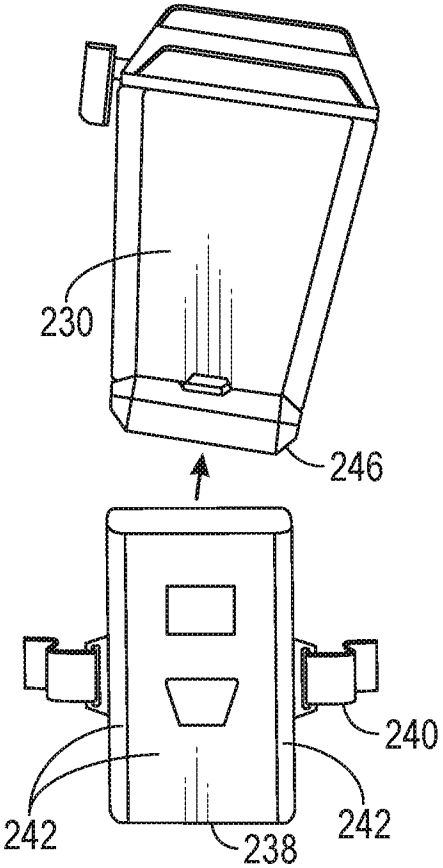
FIG. 9A is a plan view of a vacuum cleaner according to another embodiment of the invention, being separated from a holster.

As shown in FIG. 9, a vacuum cleaner 230 is configured to be received in a holster 238 that can be worn on the hip or a belt 240 of an operator. In some embodiments, the holster 238 has ribs 242 that mate with grooves (not shown) on the vacuum cleaner 230. Thus, the vacuum cleaner 230 can be worn on the operator's body or hip without needing to be carried by the operator. The vacuum cleaner 230 also has a pivotable door 246 that can be opened downwardly to empty the dirt and debris contents collected form a cleaning operation.

Figure 10A:
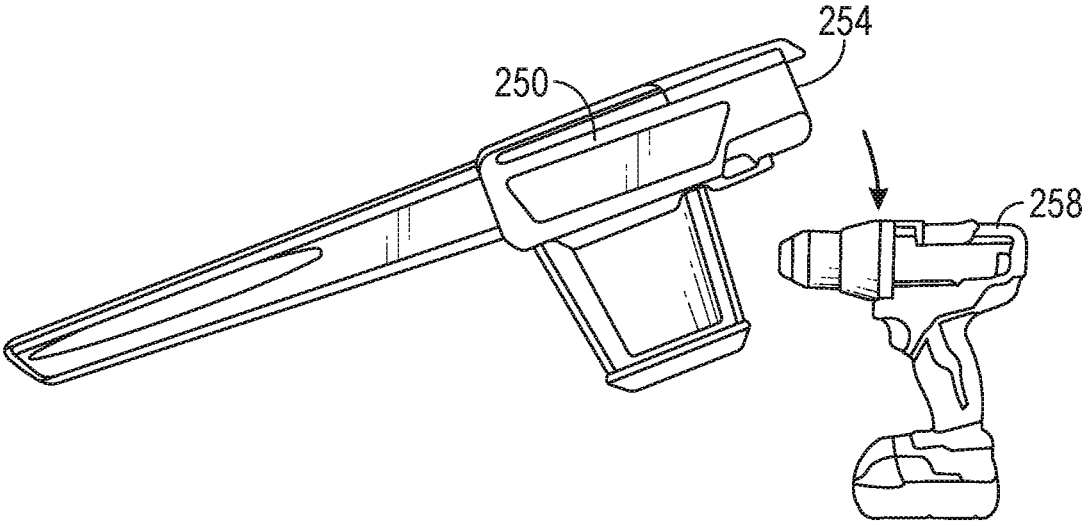
FIG. 10A is a plan view of a vacuum cleaner according to another embodiment of the invention, separated from a rotary power tool.
Figure 10B:
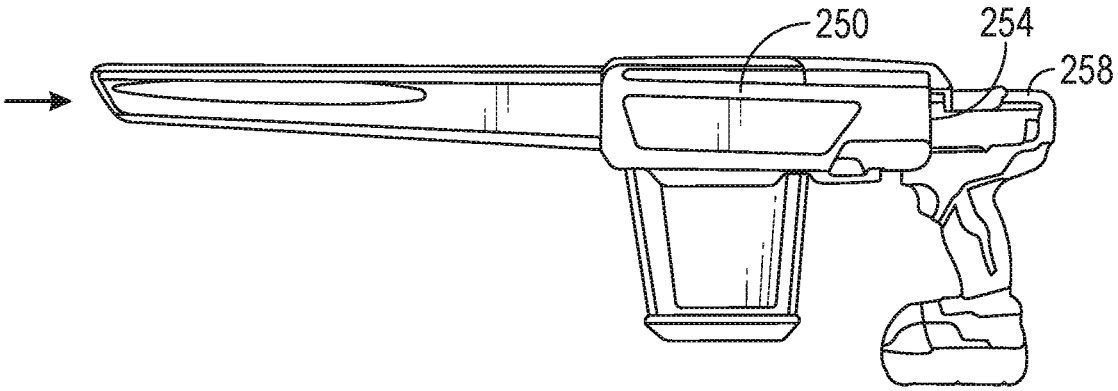
FIG. 10B is a plan view of the vacuum cleaner of FIG. 10A coupled to the rotary power tool.

As shown in FIG. 10, a vacuum cleaner 250 includes a mount 254 configured to receive a rotary power tool 258. When the power tool 258 is mounted in the mount 254, operation of the power tool 258 drives a suction motor (not shown) of the vacuum cleaner 250.

Figure 11B:
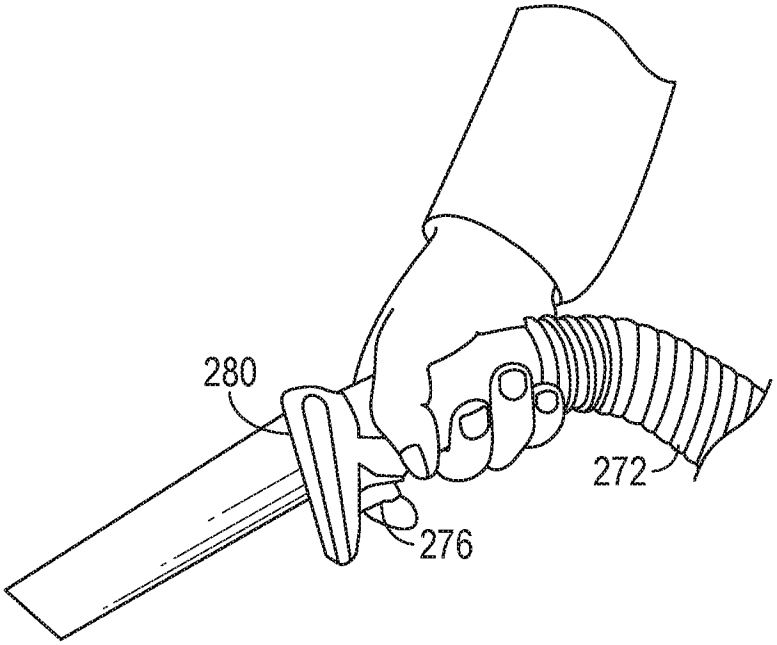
FIG. 11B is an enlarged perspective view of a hose of the vacuum cleaner of FIG. 11A.
Figure 11A:
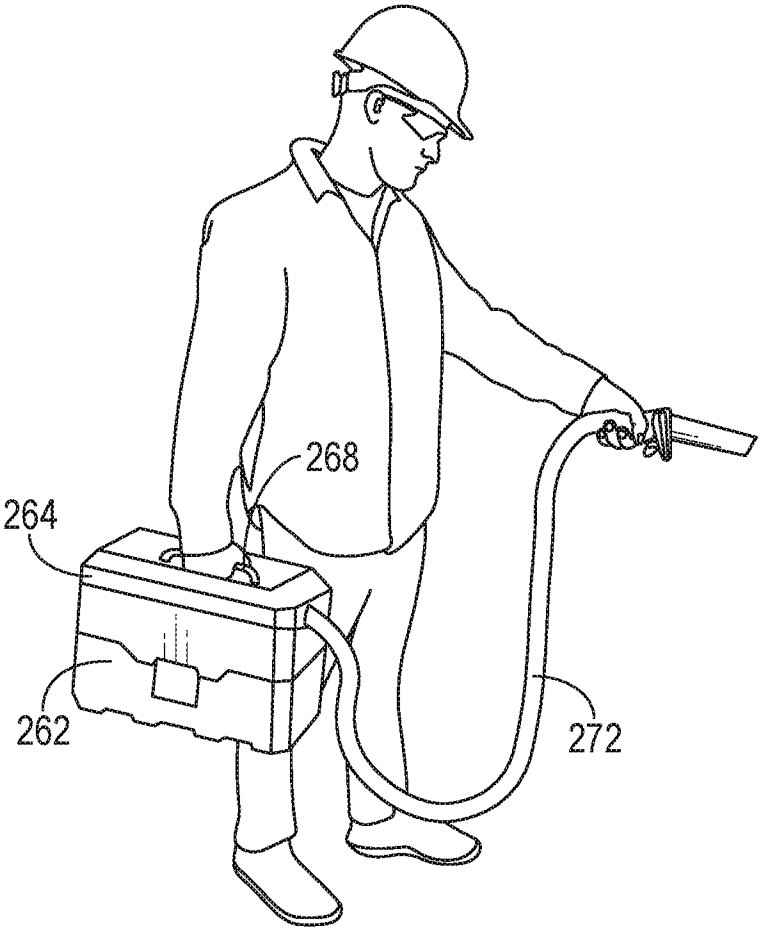
FIG. 11A is a perspective view of a vacuum cleaner according to another embodiment of the invention.

As shown in FIG. 11, a vacuum cleaner 262 has a body 264 with a shape of a tool box, a handle 268 and a hose 272 for a suction operation. The hose 272 includes wiring (not shown) that leads to a trigger 276 at a suction head 280. Thus, pressing the trigger 276 operates the suction motor (not shown) in the vacuum cleaner 262.

Figure 12A:
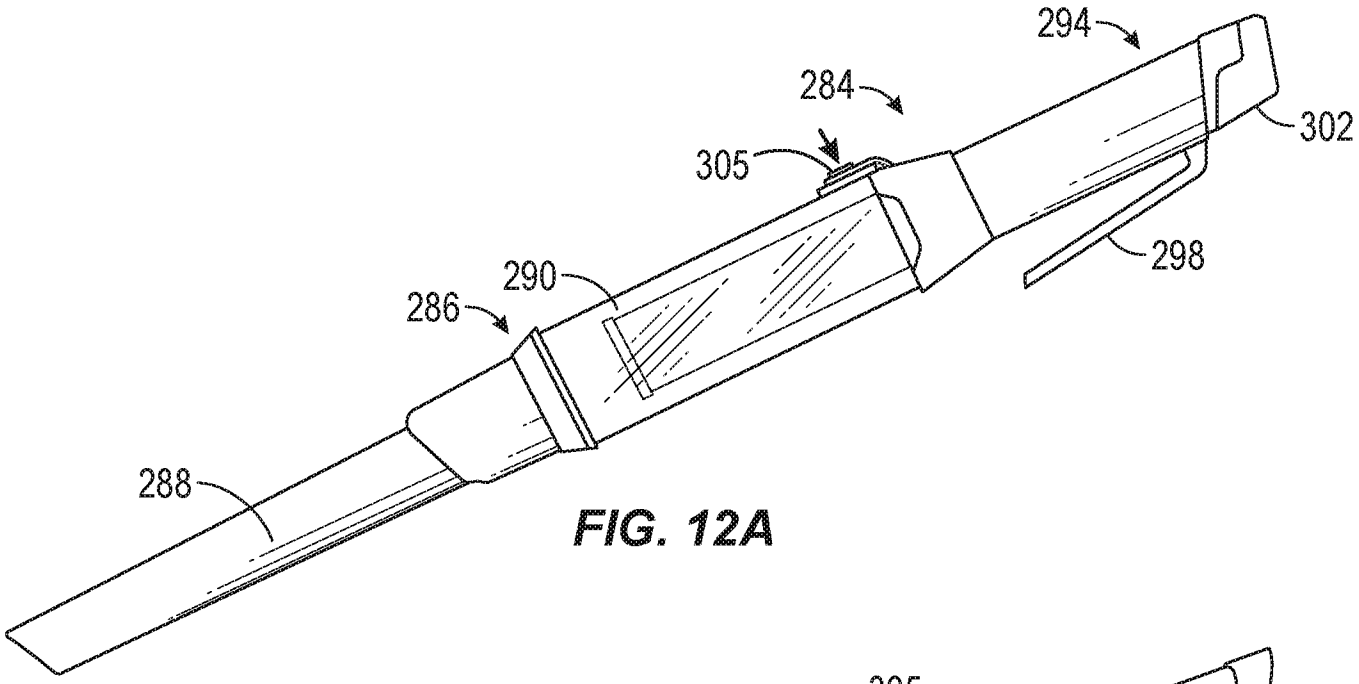
FIG. 12A is a plan view of a vacuum cleaner according to another embodiment of the invention.
Figure 12B:
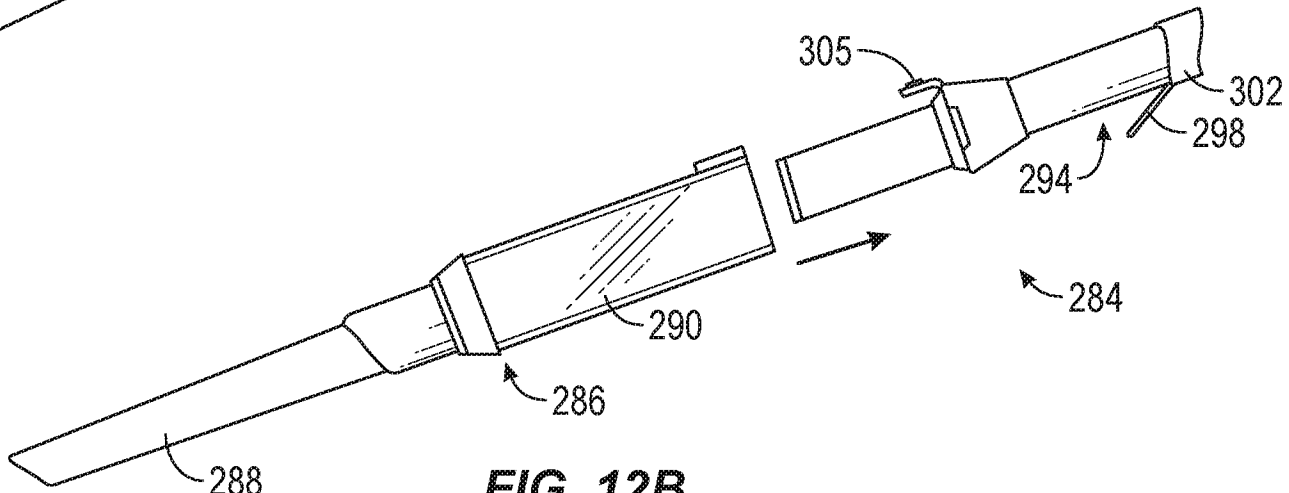
FIG. 12 B is a plan view of the vacuum cleaner of FIG. 12A, with a first portion separated from a handle portion.

As shown in FIG. 12, a vacuum cleaner 284 includes first portion 286 including a suction nozzle 288 and a debris collection chamber 290 and a handle portion 294 including a paddle trigger 298 for actuating a suction motor in the handle portion 294 that is powered by a power source such as a battery or battery pack 302. By pressing a release actuator 305 on the handle portion 294, the first portion 286 is removable from the handle portion 294 to allow the debris collection chamber 290 to be emptied.

Figure 23:
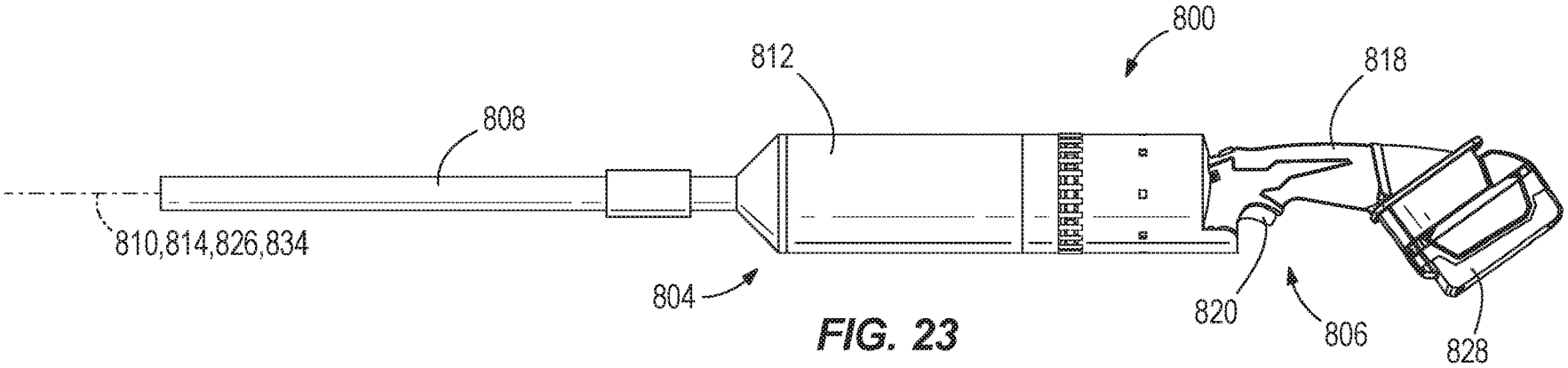
FIG. 23 is a perspective view of a vacuum cleaner according to another embodiment of the invention.
Figure 24:
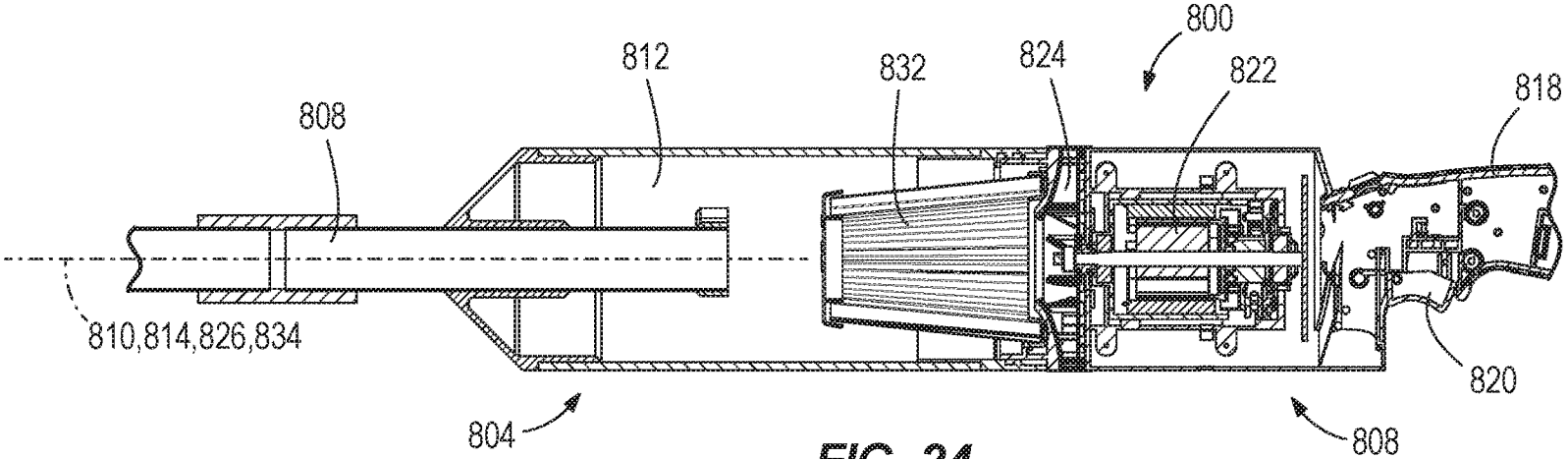
FIG. 24 is an enlarged cross-sectional view of the vacuum cleaner of FIG. 22.

FIGS. 23 and 24 illustrate a vacuum cleaner 800 includes first portion 804 including a nozzle 808 defining a first axis 810 and a debris collection chamber 812 defining a second axis 814. The vacuum cleaner also includes a second portion 816 includes a handle 818 and a trigger 820 for actuating a motor 822 that rotates a fan 824 to generate suction in the second portion 816. The first portion 804 is removably coupled to the second portion 816. The motor 822 defines a third axis 826 and is powered by a removably attachable battery pack 828 on the handle 818 of the second portion 816. In some embodiments, the battery pack 828 is a 12V battery pack and in other embodiments, the battery pack 828 is an 18 V battery pack. A pre-motor filter 832 defining a fourth axis 834 is arranged on the second portion 816 such that when the first portion 804 is coupled to the second portion 816, the filter 832 is arranged within the debris collection chamber 812, and the first 810, second 814, third 826, and fourth axes 834 are all coaxial and intersecting the handle 818 and the battery pack 828.

When the first portion 804 is coupled to the second portion 816, the vacuum cleaner 800 has a small form factor, making it easy for an operator to operate with one hand by grasping the handle 818. In operation, the operator may depress the trigger 820 to generate suction through the nozzle 808 to draw dirt and debris into the debris collection chamber 812. Air then continues to flow through the filter 832, where smaller particulate matter is filtered from the airflow, which is then exhausted through vents 836 on the second portion 816. After the suction operation has been completed, when the suction operator first portion 804 is removed from the second portion 816, the debris collection chamber 812 can be emptied. When the operator is done using the vacuum cleaner 800, the nozzle 808 is removable from the debris collection chamber 812, the vacuum cleaner 800 can be conveniently stored.

Figure 13:
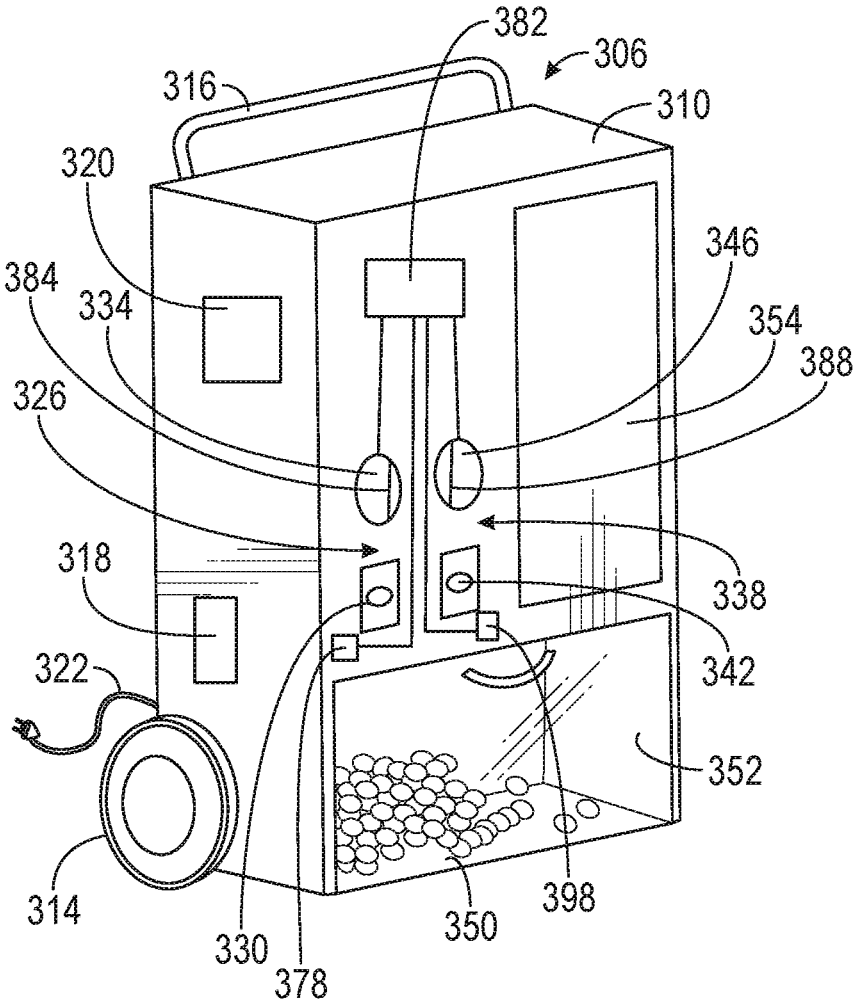
FIG. 13 is a perspective view of a vacuum cleaner according to another embodiment of the invention.

As shown in FIG. 13, a vacuum cleaner 306 includes a body 310, a plurality of wheels 314, and a handle 316 to allow an operator to pull the body 310 along the ground with the wheels 314. The vacuum cleaner 306 also includes a suction source 318, such as a motor with a fan, and a cyclonic separator 320 inside the body 310. The vacuum cleaner 306 also includes a filter fluidly coupled to the suction source and the cyclone separator. The vacuum cleaner 306 also includes an AC power cord 322 configured to attach to an AC power source, such as an electrical outlet, to provide power to the suction source 318. The vacuum cleaner 306 also includes a first tool interface 326 with a first outlet 330 and a first hose port 334, as well as a second tool interface 338 with a second outlet 342 and a second hose port 346. The vacuum cleaner 306 also includes a primary debris bin 350 behind a door 352 and a secondary debris bin behind a door 354. In some embodiments, the door 352 is transparent to allow an operator to observe how much dust and debris has accumulated in the primary debris bin 350, thus improving the life of the filter.

Figure 14:
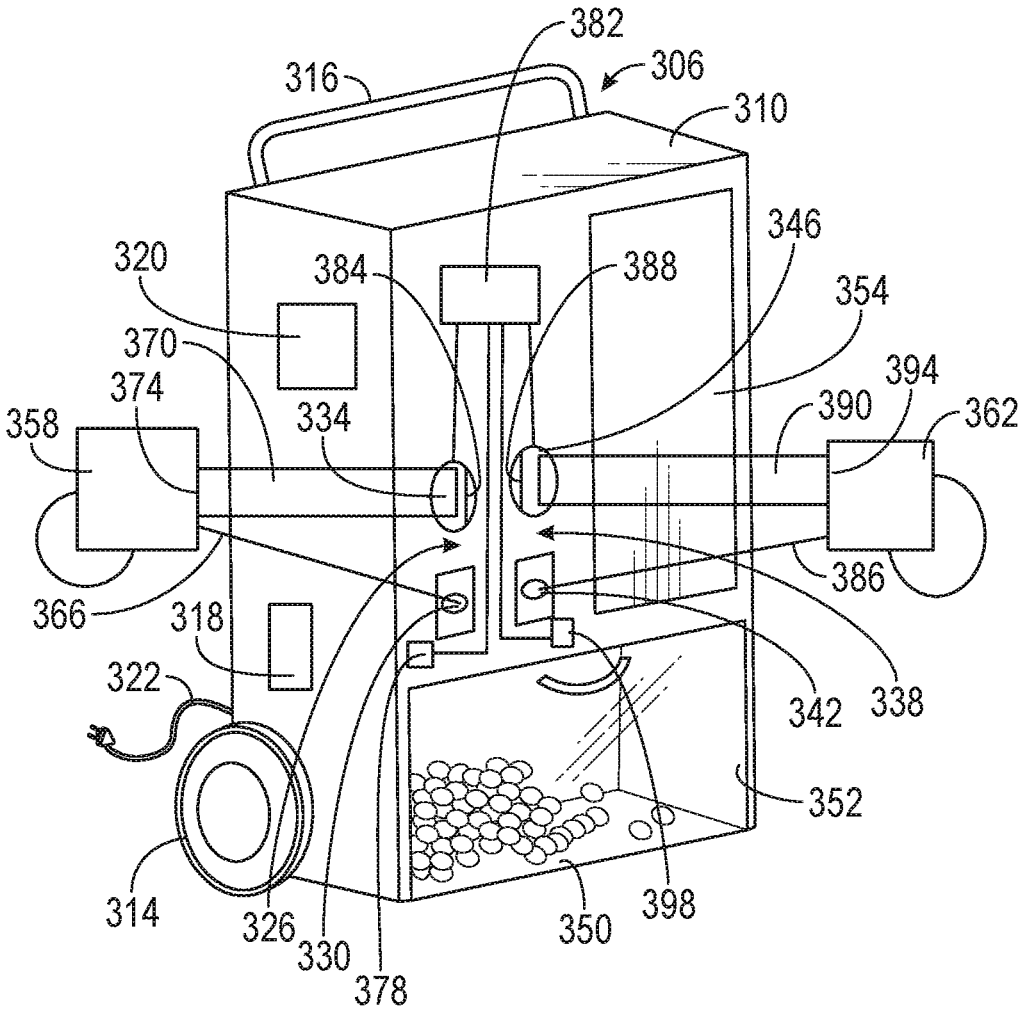
FIG. 14 is a perspective view of the vacuum cleaner of FIG. 13, with two power tools coupled thereto.

In operation, as shown in FIG. 14, an operator such as residential or commercial finish carpenter may need to use first and second power tools 358, 362 during the installation of finish woodwork on a jobsite. The operator thus plugs the AC power cord 322 of the vacuum cleaner 306 into an electrical outlet and plugs a first power cord 366 of the first power tool 358, such as a table saw, into the first outlet 330 of the first tool interface 326. The operator also couples a first hose 370 between a debris outlet 374 of the first power tool 358 and the first hose port 334 of the first tool interface 326.

The operator then turns on the first power tool 358 and uses it to perform a cutting or sawing operation, which causes dust and debris to exit the debris outlet 374 of the first power tool 358. When the first power tool 358 is turned on, a first sensor 378 in electrical communication with the first outlet 330 indicates to a controller 382 that the first power tool 358 has been turned on and is drawing current from the first outlet 330. In response, the controller 382 turns on the suction source 318 opens a first blast valve 384, such as a gate, (FIG. 13) of the first hose port 334, thus causing the suction source 318 to suction dust and debris from the debris outlet 374 of the first power tool 358 via the first hose 370 and the first hose port 334. The dust and debris is suctioned through the cyclonic separator 320, resulting in larger debris falling to the primary debris bin 350 through the cyclonic action of the cyclonic separator 320. After passing through the cyclonic separator 320, additional dust and debris is captured in the secondary debris bin behind door 354. In some embodiments, the cyclone separator 320 collects 97% of the debris in the primary debris bin 350.

When the operator is finished using the first power tool 358, the operator turns off the first power tool 358 and the first sensor 378 indicates to the controller 382 that the first power tool 358 is no longer drawing current from the first outlet 330. In response, the controller 382 closes the first blast valve 384 of the first hose port 334 and turns off the suction source 318.

The operator may then wish to use the second power tool 362, such as a miter saw. The operator thus plugs a second power cord 386 of the second power tool 362 into the second outlet 342 of the second tool interface 338. The operator also couples a second hose 390 between a debris outlet 394 of the second tool 362 and the second hose port 346 of the second tool interface 338.

The operator then turns on the second power tool 362 and uses it to perform a cutting or sawing operation, which causes dust and debris to exit the debris outlet 394 of the second power tool 362. When the second power tool 362 is turned on, a second sensor 398 in electrical communication with the second outlet 342 indicates to the controller 382 that the second power tool 362 has been turned on and is drawing current from the second outlet 342. In response, the controller 382 turns on the suction source 318 and opens a second blast valve 388, such as a gate, (FIG. 13) of the second hose port 346, thus causing the suction source 318 to suction dust and debris from the debris outlet 394 of the second power tool 362 via the second hose 390 and the second hose port 346. The dust and debris is suctioned through the cyclonic separator 320, resulting in larger debris falling to the primary debris bin 350 through the cyclonic action of the cyclonic separator 320. After passing through the cyclonic separator 320, additional dust and debris is captured in the secondary debris bin behind door 354.

When the operator is finished using the second power tool 362, the operator turns off the second power tool 362 and the second sensor 398 indicates to the controller 382 that the second power tool 362 is no longer drawing current from the second outlet 342. In response, the controller 382 closes the second blast valve 388 of the second hose port 346 and turns off the suction source 318.

After finishing using the second power tool 362, an operator may want to switch back to using the first power tool 358. Because the first power cord 366 of the first power tool 358 is already plugged into the first outlet 330 of the first tool interface 326, and because the first hose 370 is already coupled between the debris outlet 374 of the first power tool 358 and the first hose port 334 of the first tool interface 326, the operator need only turn on the first power tool 358 to operate it, with the accompanying suction operation of the vacuum cleaner 306, as described above. Thus, the first and second tool interfaces 326, 338 make it easy for an operator to seamlessly switch between operating first and second power tools 358, 362 at a jobsite, while utilizing the vacuum cleaner 306 to maintain a dust-free environment.

When the operator has finished operating, the operator may empty dust and debris from the vacuum cleaner 306 by opening the doors 352, 354 to access the primary 350 and secondary debris bins.

In some embodiments, two separate operators may respectively use the first and second power tools 358, 362 with vacuum cleaner 306 simultaneously. Specifically, as both tools 358, 362 are turned on and operating, the first and second sensors 378, 398 respectively indicate that current is being drawn from the first and second outlets 330, 342. In response the controller 382 turns on the suction source 318 and opens both the first and second blast valves 384, 388 of the first and second hose ports 334, 346, allowing dust and debris to be suctioned from the first and second power tools 358, 362 while they are operating simultaneously.

Figure 25:
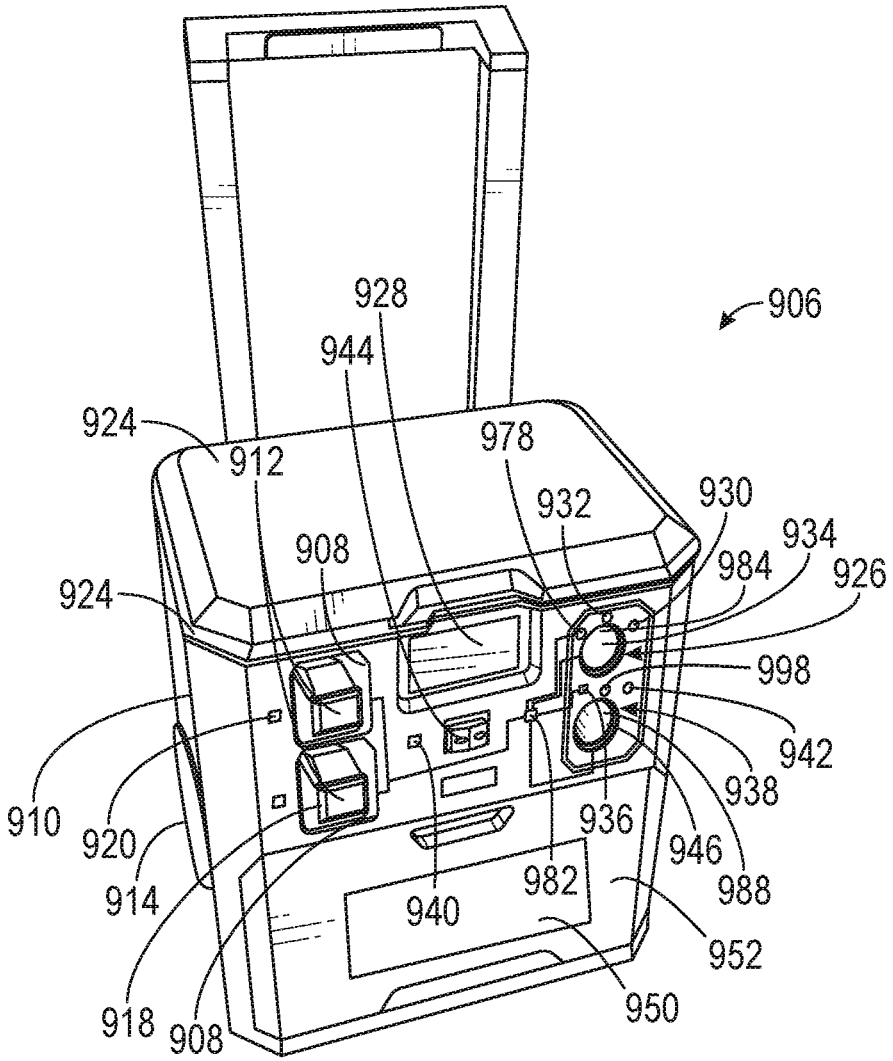
FIG. 25 is a perspective view of a vacuum cleaner according to another embodiment of the invention.

FIG. 25 illustrates a vacuum cleaner 906 that is substantially similar to the vacuum cleaner 306, with like parts having the same annotation plus 600, and the following differences and additions explained below. Unlike the vacuum cleaner 306, the vacuum cleaner 906 omits a second door for a secondary debris bin. Also unlike the vacuum cleaner 306, the vacuum cleaner 906 includes two battery receptacles 908 for respective receipt of two battery packs 912 that, when received in the receptacles 908, provide power to the suction source 918 and the first and second tool interfaces 928, 938. The vacuum cleaner 906 includes a lid 924 for covering up a storage space 928 for storing tools and the like. The handle 916 is telescoping with respect to the housing 910.

On the first tool interface 926, a first indicator 932, such as an LED, can light up or change colors to indicate that the first power cord 366 of the first tool 358 is plugged into the first outlet 930 and turned on. Specifically, in response to the first tool 358 drawing power from the first outlet 930, the first sensor 978 indicates to the controller 982 that the first tool 358 has been turned on and is drawing current from the first outlet 930, and the first indicator 932 is set to a first state. When the first tool 358 is turned off or unplugged from the first outlet 930, the first sensor 978 indicates to the controller 982 that the first tool 358 is not drawing current from the first outlet 930, and the first indicator 932 is set to a second state that is different from the first state.

On the second tool interface 938, a second indicator 936, such as an LED, can light up or change colors to indicate that the second power cord 386 of the second power tool 362 is plugged into the second outlet 942 and turned on. Specifically, in response to the second power tool 362 drawing power from the second outlet 942, the second sensor 998 indicates to the controller 982 that the second power tool 362 has been turned on and is drawing current from the second outlet 942, and the second indicator 936 is set to a first state. When the second power tool 362 is turned off or unplugged from the second outlet 942, the second sensor 998 indicates to the controller 982 that the second power tool 362 is not drawing current from the second outlet 942, and the second indicator 936 is set to a second state that is different from the first state.

The vacuum cleaner 906 also includes an actuator 944 that can turn the vacuum cleaner 906 on or off. When the actuator 944 turns the vacuum cleaner 906 is off, the suction source 918 cannot generate suction and the first and second power tools 358, 362 cannot draw power from the vacuum cleaner 906.

The vacuum cleaner 906 also includes a wireless communication unit 940, such as a transceiver or a receiver, that is configured to receive signals from the first and second power tools 358, 362. In some embodiments of vacuum cleaner 906, the first and second outlets 930, 942 are omitted and instead of drawing power from the vacuum cleaner 906, the first and second power cords 366, 386 of the first and second power tools 358, 362 are plugged into alternative AC sources, or independently run off battery power. Thus, in embodiments of vacuum cleaner 906 where the first and second outlets 930, 942 are omitted, the wireless communication unit 940 of the vacuum cleaner 906 is configured to receive signals from the first and second power tools 358, 362 to determine if and when they are turned on.

In operation, when the operator turns on the first power tool 358, the wireless communication unit 940 receives a wireless first tool signal from a transceiver or transmitter of the first power tool 358 indicating that the first power tool 358 has been turned on. In response to the wireless communication unit 940 receiving the wireless first tool signal from the first power tool 358, the controller 982 turns on the suction source 918 and opens the first blast valve 984 of the first hose port 934, thus causing the suction source 918 to suction dust and debris from the debris outlet 374 of the first power tool 358 via the first hose 370 and the first hose port 934. In response to the wireless first tool signal being received by the wireless communication unit 940, the first indicator 932 is set to the first state.

When the operator is finished using the first power tool 358, the operator turns off the first power tool 358, such that the wireless first tool signal from the first power tool 358 is no longer sent to the wireless communication unit 940. In response, the controller 982 closes the first blast valve 984 of the first hose port 934, turns off the suction source 918, and sets the first indicator 932 to the second state. The operator then turns on the second power tool 362 and uses it to perform a cutting or sawing operation, which causes dust and debris to exit the debris outlet 394 of the second power tool 362. When the second power tool 362 is turned on, a transceiver or transmitter of the second power tool 362 sends a wireless second tool signal to the wireless communication unit 940. In response to the wireless communication unit 940 receiving the wireless second tool signal from the second power tool 362, the controller 982 turns on the suction source 918 and opens the second blast valve 988 of the second hose port 946, thus causing the suction source 918 to suction dust and debris from the debris outlet 394 of the second power tool 362 via the second hose 390 and the second hose port 946. In response to the wireless second tool signal being received by the wireless communication unit 940, the second indicator 936 is set to the first state.

When the operator is finished using the second power tool 362, the operator turns off the second power tool 362, such that the wireless second tool signal from the second power tool 362 is no longer sent to the wireless communication unit 940. In response, the controller 982 closes the second blast valve 388 of the second hose port 346, turns off the suction source 918, and sets the second indicator 936 to the second state. Two separate operators may respectively use the first and second power tools 358, 362 with vacuum cleaner 906 simultaneously. Specifically, as both of the first and second power tools 358, 362 are turned on and operating, the first and second power tools 358, 362 respectively send first and second wireless tool signals to the wireless communication unit 940, and in response, the controller 982 turns on the suction source 918, sets both the first and second indicators 932, 936 to their first states, and opens both the first and second blast valves 984, 988 of the first and second hose ports 934, 946, allowing dust and debris to be suctioned from the debris outlets 374, 394 of the first and second power tools 358, 362 while they are operating simultaneously.

Figure 26:
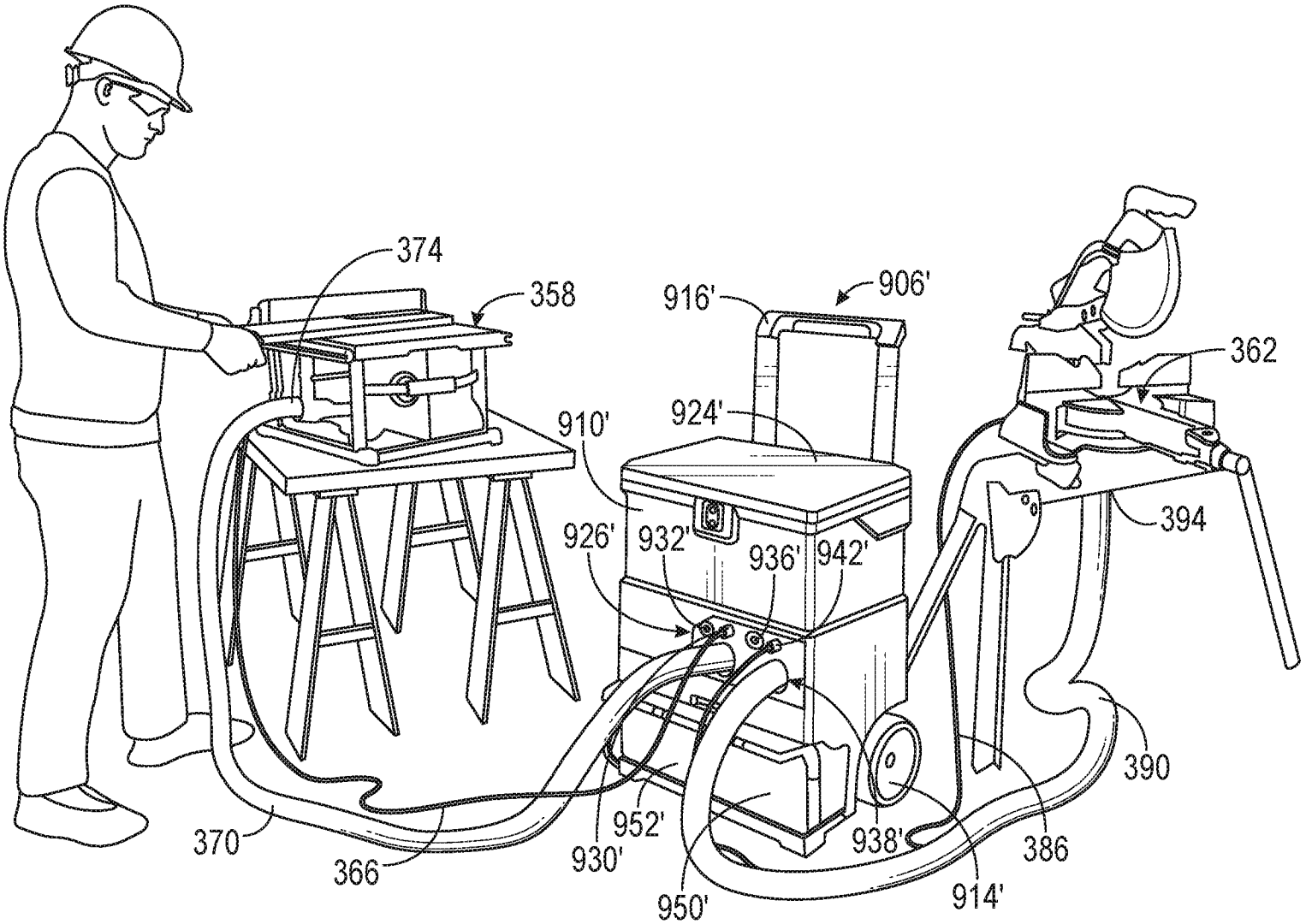
FIG. 26 is a perspective view of the vacuum cleaner of claim 25 with two power tools coupled thereto.

FIG. 26 illustrates a vacuum cleaner 906' that is substantially identical to the vacuum cleaner 906, except the position of the battery receptacles 908' and hose ports 934', 946' are in different locations on the housing 910' than in the vacuum cleaner 906.

Figure 27:
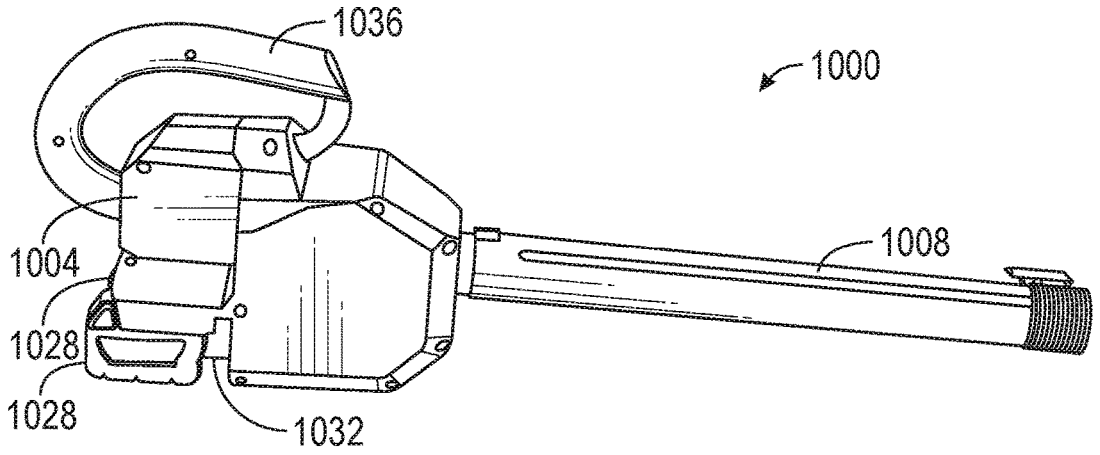
FIG. 27 is a perspective view of a vacuum cleaner according to another embodiment of the invention.
Figure 28:
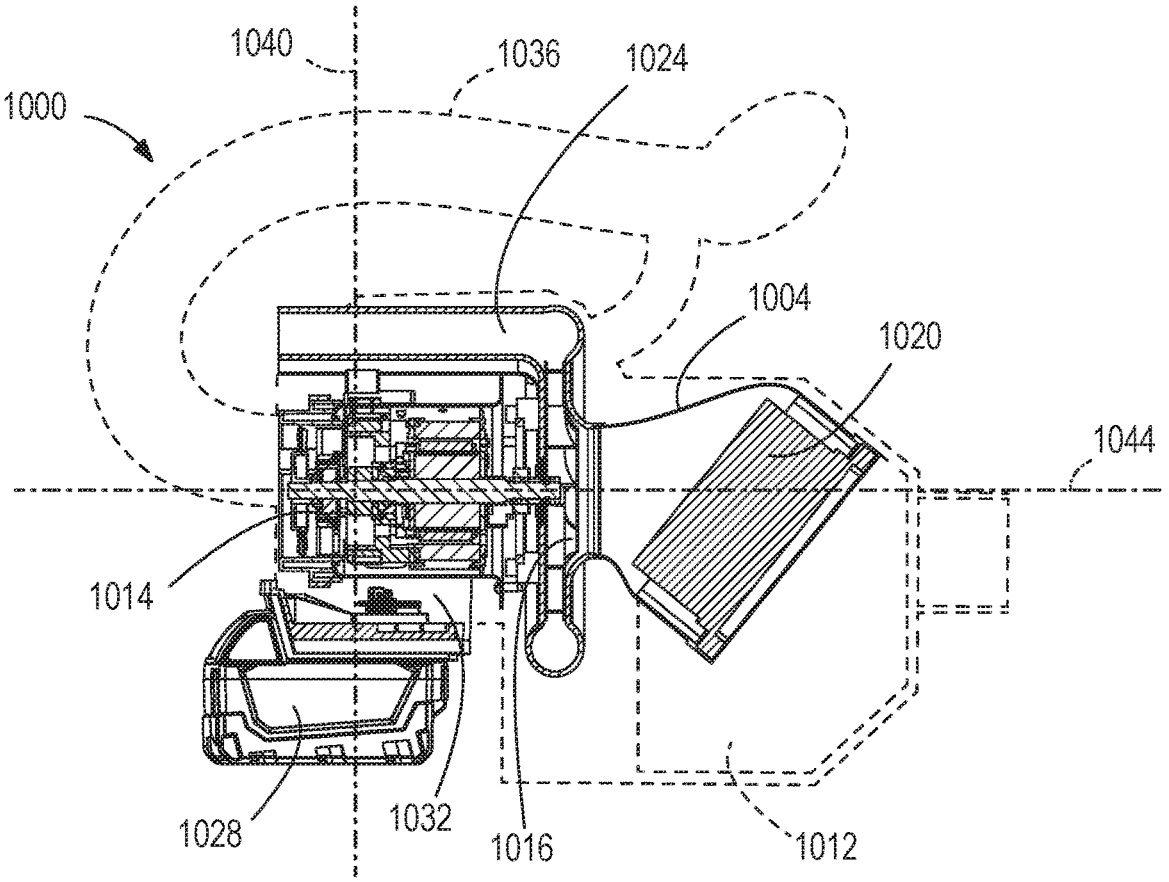
FIG. 28 is an enlarged perspective view of the vacuum cleaner of claim 27, with portions removed.
Figure 29:
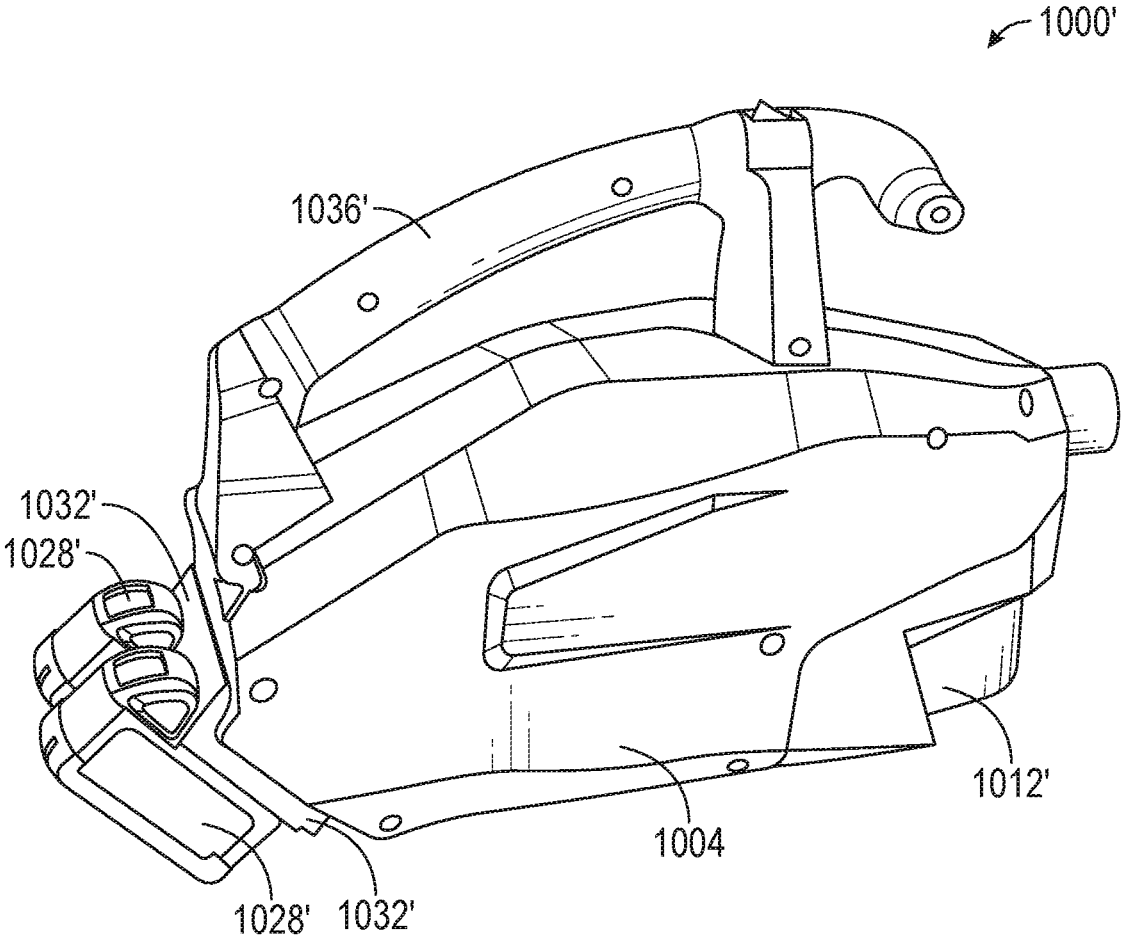
FIG. 29 is a perspective view of a vacuum cleaner according to another embodiment of the invention.

FIGS. 27 and 28 illustrate a vacuum cleaner 1000 having a housing 1004, a nozzle 1008 selectively removable from the housing 1004, a debris collection chamber 1012, and a motor 1014 driving a fan 1016 to generate suction. The fan 1016 is in fluid communication with the nozzle 1008 and the debris collection chamber 1012. A pre-motor filter 1020, such as a HEPA filter, is arranged in the debris collection chamber 1012 and the fan 1016 is arranged in an exhaust channel 1024 to exhaust the suction airflow. A pair of batteries 1028 are removably coupled to battery receptacles 1032 on the housing 1004 to provide power to the motor 1014. The housing 1004 includes a handle 1036 and the motor 1014 is arranged between the battery receptacles 1032 and the handle 1036 along a first axis 1040 that is perpendicular to a motor axis 1044. FIG. 29 illustrates a vacuum cleaner 1000' is substantially similar to the vacuum cleaner 100, but has a different shape than the vacuum cleaner 1000 and a removable debris collection chamber 1012'.

In some embodiments, the vacuum cleaners described in this application are configured to clean up a dry mess at ground level. In some embodiments, the vacuum cleaners are configured to clean up a dry mess at standing height on enclosed work sites. In some embodiments, the vacuum cleaners can be used on plywood, concrete or finished floors. In some embodiments, the vacuum cleaners can be used for mechanical, electrical and plumbing cleanup or maintenance, repair, and operations task cleanup. In some embodiments, the vacuum cleaners can clean up multiple floors with small collected piles or punch list messes.

In some embodiments, the vacuum cleaners described in this application are configured to pick up sawdust and mixed debris up to 0.75 inches to 1 inch in diameter. In some embodiments, the vacuum cleaners can pick up nails, screws, nuts, metal knockouts that are up to 1 inch and washers that are up to 1 inch. In some embodiments, the vacuum cleaners can pick up drywall. In some embodiments, the vacuum cleaners can pick up small metal or PVC shavings. In some embodiments, the vacuum cleaners can be used in HVAC, electrical or tile trades.

In some embodiments, the vacuum cleaners described in this application have a compact form factor. In some embodiments, the vacuum cleaners provide a high level of suction. In some embodiments, the vacuum cleaners allow a high level of control. In some embodiments, the vacuum cleaners have quick operation. In some embodiments, the vacuum cleaners require little or no setup. In some embodiments, the vacuum cleaners are lightweight. In some embodiments, little or no bending of the operator is required in order to use the vacuum cleaners.

In some embodiments, accessories for use with the vacuum cleaners can be provided to certain tradesmen with smart storage options, such as rigid and flexible hoses, as well as floor, crevice and brush tools. In some embodiments, the vacuum cleaners are relatively quiet.

Various features of the invention are set forth in the following claims.

What is claimed is:

1. A portable vacuum cleaner assembly comprising:

a first portable vacuum and a second portable vacuum cleaner, wherein each of the first and second portable vacuum cleaners include a housing including a storage space, a lid coupled to the housing, the lid moveable between an open position, in which access to the storage space is provided, and a closed position, in which access to the storage space is blocked, a handle coupled to the housing, a suction source supported in the housing, a debris collection chamber in fluid communication with the suction source, a battery receptacle on the housing, the battery receptacle configured to selectively receive a battery pack that is configured to provide power to the suction source, and a hose port on the housing, the hose port in fluid communication with the suction source, wherein the housing of the first portable vacuum has a first size and the housing of the second portable vacuum has a second size that is greater than the first size, and wherein the first portable vacuum is configured to be stacked upon the second portable vacuum.

2. The portable vacuum cleaner assembly of claim 1, wherein the housing of the first portable vacuum cleaner has a first length and a first width, and the housing of the second portable vacuum cleaner has a second length and a second width, and wherein one of the first length and first width is substantially equal to one of the second length and the second width.

3. The portable vacuum cleaner assembly of claim 2, further comprising a third portable vacuum cleaner including a housing including a storage space, a lid coupled to the housing, the lid moveable between an open position, in which access to the storage space is provided, and a closed position, in which access to the storage space is blocked, a handle coupled to the housing, a suction source supported in the housing, a debris collection chamber in fluid communication with the suction source, a battery receptacle on the housing, the battery receptacle configured to selectively receive a first battery pack that is configured to power to the suction source, and a hose port on the housing, the hose port in fluid communication with the suction source, wherein the housing of the third portable vacuum has a third size that is greater than the second size, and wherein the second portable vacuum is configured to be stacked upon the third portable vacuum.

4. The portable vacuum cleaner assembly of claim 3, wherein the housing of the third portable vacuum cleaner has a third length and a third width, and wherein one of the third length and third width is substantially equal to one of the second length and the second width, and wherein one of the third length and third width is substantially equal to one of the first length and the first width.

5. The portable vacuum cleaner assembly of claim 4, wherein the handle of the third portable vacuum cleaner is telescoping.

6. The portable vacuum cleaner assembly of claim 5, wherein the battery pack receptacle of the third portable vacuum cleaner is a first battery pack receptacle that is configured to receive a first battery pack, and wherein the third portable vacuum cleaner includes a second battery pack receptacle configured to receive a second battery pack.

7. The portable vacuum cleaner assembly of claim 6, further comprising a hose that is configured to be selectively coupled to each of the hose ports of the first, second, and third portable vacuum cleaners.

8. The portable vacuum cleaner assembly of claim 7, further comprising a bracket on at least one of the first, second, and third portable vacuum cleaners, and wherein the hose is configured to be stored on the bracket.

9. The portable vacuum cleaner assembly of claim 8, further comprising an actuator on each of the first, second, and third portable vacuum cleaners, the actuators configured to selectively communicate power from the respective battery packs to the respective suction sources.

* * * * *